US005768675A

United States Patent [19]

Estabrooks

[11] Patent Number: 5,768,675

[45] Date of Patent: Jun. 16, 1998

[54] ON-DEMAND NARROW WEB ELECTROPHOTOGRAPHIC PRINTER

[75] Inventor: David A. Estabrooks, Newburyport, Mass.

[73] Assignee: Intermec Corporation, Everett, Wash.

[21] Appl. No.: 698,814

[22] Filed: Aug. 16, 1996

[51] Int. Cl.[6] ..... G03G 15/00

[52] U.S. Cl. ..... 399/385; 399/406; 101/66; 101/224; 101/227

[58] Field of Search ..... 399/384, 385, 399/406; 346/24; 347/153, 157; 358/304; 101/66, 91, 92, 224–230; 226/24

[56] References Cited

U.S. PATENT DOCUMENTS

| | | | |
|---|---|---|---|
| 3,639,053 | 2/1972 | Spear, Jr. | 399/385 |
| 4,115,817 | 9/1978 | Suzuki et al. | 347/153 X |
| 4,819,024 | 4/1989 | Kagayama et al. . | |
| 5,019,872 | 5/1991 | Zajac, Jr. . | |
| 5,036,359 | 7/1991 | Duijve et al. | 399/389 |
| 5,041,850 | 8/1991 | Kahoyahi et al. . | |
| 5,061,967 | 10/1991 | Isobe . | |
| 5,099,290 | 3/1992 | Yokota | 395/111 |
| 5,130,724 | 7/1992 | Crowley . | |
| 5,170,215 | 12/1992 | Pfeuffer . | |
| 5,185,627 | 2/1993 | Hartman . | |
| 5,189,470 | 2/1993 | Matsuda et al. . | |
| 5,202,737 | 4/1993 | Hollar | 399/406 |
| 5,210,583 | 5/1993 | Monma . | |
| 5,216,471 | 6/1993 | Kajita et al. | 399/385 |
| 5,237,378 | 8/1993 | McEwen | 399/21 |
| 5,257,567 | 11/1993 | Walker et al. | 83/74 |
| 5,281,991 | 1/1994 | Oonishi et al. | 355/29 |
| 5,291,249 | 3/1994 | Lee | 399/113 |
| 5,296,906 | 3/1994 | Hano et al. . | |
| 5,321,437 | 6/1994 | Heeren . | |
| 5,396,313 | 3/1995 | Zoltner et al. | 399/23 |
| 5,408,304 | 4/1995 | Serizawa . | |
| 5,442,382 | 8/1995 | Pfeuffer . | |
| 5,581,293 | 12/1996 | Wiklof | 347/153 X |

*Primary Examiner*—Matthew S. Smith
*Attorney, Agent, or Firm*—Lahive & Cockfield, LLP

[57] ABSTRACT

An on-demand narrow web electrophotographic printer and method of printing forms a latent image and a narrow web paper feeding mechanism feeds paper from a roll for closely spaced printouts of tickets or labels, such as adhesive-backed labels, for bar codes, receipts of arbitrary length, or lottery tickets. An endless rotary latent image carrier mechanism and cutter blade are synchronized with a paper infeed mechanism, a fixing unit, and an outfeed to feed, print and cut the paper printout at a controlled length and with no paper wastage. In different embodiments, a length of paper is either accumulated in advance or drawn back to a position ahead of the drum to allow on-demand operation without sacrificing printing efficiency. Preferably, one or more web transport assemblies are separately-driven, and phase differences between image forming and sheet transport steps are accommodated by separating the sheet for printing, accumulating a feed loop in the imaging path, or actuating a drive to pull back the web during operation. This synchronization allows low-cost laser printer technology to efficiently produce short narrow-web prints on-demand.

34 Claims, 16 Drawing Sheets

ON-DEMAND NARROW WEB ELECTROPHOTOGRAPHIC PRINTER

BACKGROUND

The present invention relates to an intermittently-operable narrow web electrophotographic printer and to a method of printing which forms a toned image on a latent image carrier, transfers the toned image to a portion of a narrow web formed of paper or other media to make a print, and precisely cuts or separates the print from the web, to yield a document such as a receipt, label, or bar code sticker having a small but defined margin.

The vast majority of such "on-demand" narrow web printing is generally performed in dot matrix printers, ink jet or thermal printers, utilizing printing processes that are relatively simple, compared with those of electrophotographic printers, and which involve the direct application of pigment, or pigment-converting energy, to the imaged web. Conventional electrophotographic devices on the other had are constrained by the fixed and generally large spacing along the image process line of their imaging drums, toning systems and fixing units, so that they are generally designed to print on large forms of one or more fixed lengths. This printing in a repetitive or continuous form mode tends to waste paper when starting and stopping, and is not well adapted to smaller print items, such as tickets or labels. This is especially true for typical electrophotographic assemblies where the image-forming process line is comparable in length to a page length.

Current on-demand narrow web printing methods tend to have a lower printing resolution, or a higher cost of operation than photocopiers or laser printers, since they do not print on low cost plain paper, and there is therefore a need for an on-demand narrow web electrophotographic printer, which can provide high printing resolution on plain paper with bulk commercial toners, yet has a sufficiently low capital cost. Such a device may be expected to operate inexpensively, and could satisfy the rapidly growing demand for narrow web printouts in transaction markets such as ATM, lottery ticket, retail sales receipt, product marking and bar code labeling applications.

However, conventional electrophotographic methods generally require rotation of a photoconductive drum or belt at a uniform speed for laying down an image before the toned image reaches the transfer unit, and at this point when the image is transferred onto the paper or recording medium, it is fed at a speed identical with the peripheral speed of the drum surface, past the point of image transfer. Since coordination of these imaging speeds takes a certain time interval, and requires alignment of web and drum positions, these constraints make such printing methods ill-suited to printing individual labels, or receipts, especially ones of small or variable length. To control printing without waste or document damage, a predetermined form or document length would seem to be necessary. However, even when a fixed form length is used, paper margins in continuous form can be excessive due to paper positioning constraints, and paper or labels are wasted when frequently starting and stopping the printing process.

Thus, there is a need for a cost effective printer which can produce printouts intermittently, interrupting or starting and stopping the process, particularly for closely spaced or variable length printouts such as tickets and labels, without wasting paper.

SUMMARY AND OBJECTS OF THE INVENTION

It is a primary object of the present invention to solve the paper wasting problems of conventional electrophotographic printers and provide a cost effective on-demand narrow web print apparatus.

It is also an object of the present invention to provide a printing apparatus and method which has a low cost of the printer and its consumables, and a low frequency of replacement of consumables.

It is another object of the invention to provide a printing apparatus which operates intermittently or on-demand to print closely spaced prints without wasting paper.

It is a further object of this invention to provide a high speed on-demand narrow web electrophotographic printing apparatus which occupies a small area, and provides a short, preferably straight paper path.

It is a further object of this invention to provide an on-demand narrow web electrophotographic receipt printing apparatus which images electrical input data, transfers the image to a portion of recording paper at the leading end of a feed roll, and fuses the image on the paper to produce a printout separated from the paper feed roll.

It is a further object of this invention to provide a high speed on-demand narrow web electrophotographic printing apparatus which prints character lines one at a time to produce a point of sale receipt or ticket.

It is a further object of this invention to provide an on-demand narrow web electrophotographic printing apparatus which prints on various media including roll paper, continuous forms, and cut sheets.

Applicant achieves one or more of the foregoing and other objects of the present invention with a printing apparatus having a printer memory which stores image information data for at least one character line at a time, and electrophotographically images the data, synchronizing image-forming and paper-severing operations to print out a ticket, label, or receipt, which may vary in length depending on the data, but which has a small margin or size. A continuous web of paper or other print medium is directed along a short paper feeding path for conveyance to the print out, while a feeding mechanism feeds the paper from the paper roll along the feeding path past an endless rotary latent image carrier mechanism. An image forming unit with a high capacity toner cartridge forms a toned image on the latent image carrier, and this image is transferred onto the paper conveyed along the feed path. A fixing unit fixes the toned image on the printout, and a severing unit cuts a sheet from the paper roll to form a print, which may be a label or ticket having a small defined size, or other printout having small margins about a printed text region of small size. The web is cut in the printer such that the trailing edge of one print is at the leading edge of the next print.

The feeding mechanism is driven separately to feed the paper along the feeding path from a paper roll to a printout severing point in the printing process line, and paper velocity is matched to the peripheral velocity of the rotary image carrier drum mechanism during image transfer, so transfer of the toned image onto the paper in the feeding path takes place at constant velocity without relative motion in the tangential plane at the transfer point. The front edge of the paper is synchronized with a precise position on the imaging drum or carrier, to meet the start of the image on the drum precisely at the point of image transfer to the paper with only a small margin at the front edge of the printout. A similar margin is left at the trailing edge, which is the leading edge of the next printout; this reduces paper waste to a fixed low limit consistent with registration tolerances. As the toned image is transferred to the paper from the imaging drum, the paper printout is advanced by the feeding mechanism through a fixing unit, and fixing takes place as the paper moves forward to the end of travel to complete the printout. After transferring and fixing of the image, the printout is ejected from the print path. Severing of the print sheet may be done ahead of the imaging drum, or after the drum, but in any case the remaining feed supply is coordinated with the processing stages for the next print, and small margins are obtained in each consecutive print.

BRIEF DESCRIPTION OF THE DRAWINGS

These and other features and advantages of the present invention will be understood by those skilled in the art from the following description, taken in conjunction with the accompanying drawings of illustrative embodiments, wherein.

DETAILED DESCRIPTION

Figure 1:
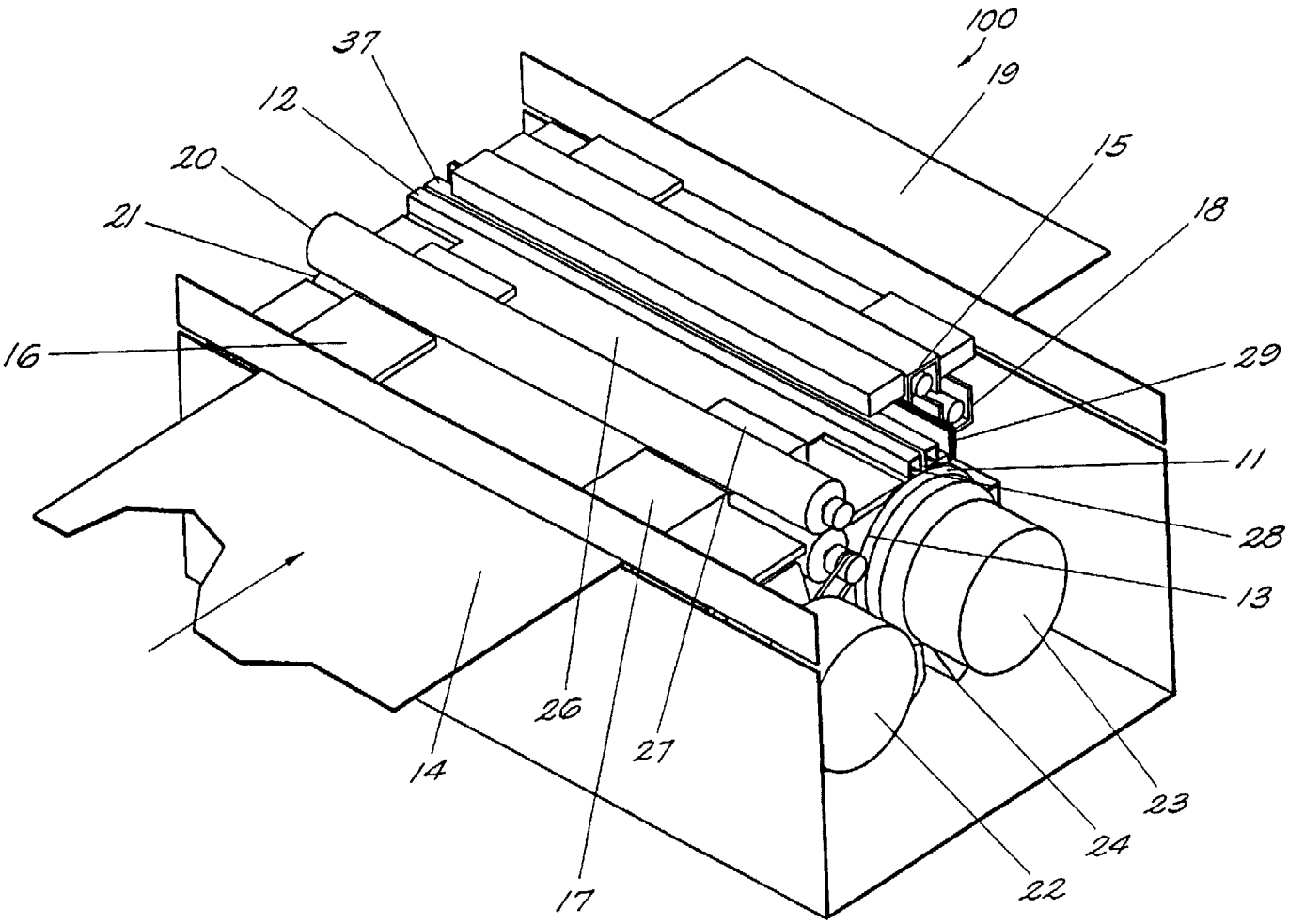
FIGS. 1, 2 and 3 show a first embodiment of an on-demand narrow web electrophotographic printer in accordance with the present invention configured with an overhead paper transport path.
Figure 2:
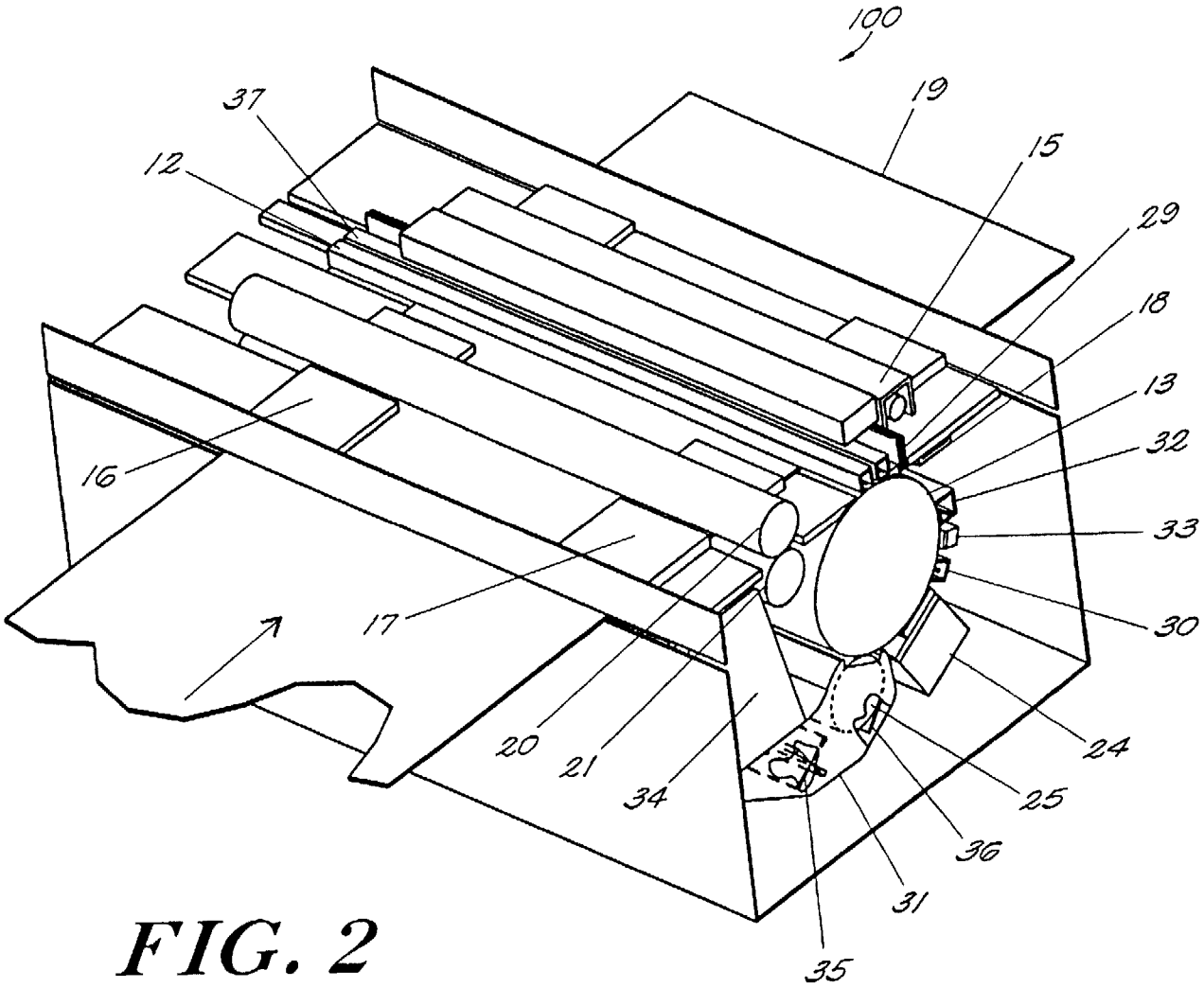
Figure 3:
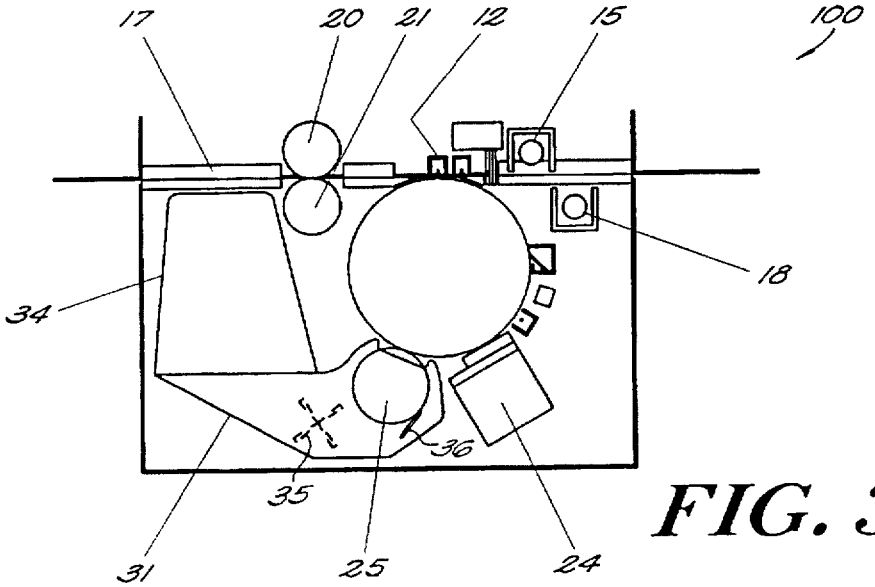

FIGS. 1–3 show a first illustrative embodiment 100 of an on-demand narrow web electrophotographic printer according to the present invention, and having an overhead paper transport aligned along a straight-through printing path.

The basic structure of one embodiment of this printing apparatus addresses the problem of providing a complete imaging apparatus while arranging the numerous components to define a short process line so as to prevent wasted paper. Printer 100 includes a paper feeding mechanism including feed rollers 20, 21 synchronized with a latent image carrier 13 and an image transfer assembly 12 at a transfer position 11 which is effective to transfer the toned image from the carrier 13 onto a paper web 14. The paper 14 is fed past the transfer position to a toner preheater 15 along a transport path defined by various rollers, support plates, and by paper guides such as shown at 16 and 17 which generally extend in a narrow band over marginal edges of the web and hold it flat as it moves along a channel or tray defining a short feed path. A fixing unit 18 fixes the toner image on the web to form a final print or printout 19, and a severing unit 29 is actuated, in this embodiment, to detach the printout 19 at the end of the fixed image region.

Infeed rollers 20 and 21 are located at an opening adjacent to the paper supply which is preferably a roll (not shown) which may have a width of between one and six inches, most preferably between about one and a half and three inches. The rollers are powered by a feed roller motor 22 (FIG. 1) which is controlled to feed out the paper 14 between paper guides 16 and 17 from the paper roll and to advance the paper 14 to the image transfer unit 12, the severing unit or cutter bar 29, and the fixing unit 18 on the opposite side of the feeding path. A second motor 23 independently drives the photosensitive carrier 13, referred to herein for ease of reference as an "OPC" drum, rotating the drum at constant angular velocity, and an LED or laser printhead 24 or similar imaging assembly scans the drum 13 to create a latent charge image, which is toned by a development roller 25 (FIG. 2).

The drum drive motor 23 is a stepper motor which directly drives the drum, and since the distance between the latent imaging printhead 24 and the toned image transfer position 11 is fixed, a fixed number of the stepper position signals indicate when a latent imaged line has passed the developer roll 25 and reaches the transfer position. Similarly, the feed roller 22 is driven by a stepper motor, and thus determines both the paper position and velocity of the paper traveling in the print path. A simple microcontroller receives and operates on these two sets of stepper signals to initiate the various transport motions described herein, and to synchronize them with the laser image writing of electronic text or graphic line data, and the printing, cutting and fusing of the print. The controller may also receive the outputs of position detectors, as described more fully below.

In this embodiment, the paper feed motor 22 is operated after severing the finished print at the end of each print cycle to draw back the front edge of the paper web 14 to a start position 26, indicated by a dashed line in the FIGURE, which is a very short distance in front of the OPC drum transfer position 11. At the start of the next print cycle, the front edge of the paper 14 is then sensed by a detector 27 to confirm its alignment at start position 26, and the controller having verified the presence of the leading edge at the start position, actuates the stepper motor 23 of the OPC drum 13, or a DC motor, to accelerate the drum to a predetermined constant feed speed, which may be a peripheral velocity of up to about six inches per second or faster, and preferably maintains this constant speed during the remainder of the print cycle. Once attaining this speed, laser imaging of the print data is commenced by actuating the LED or laser printhead 24 to direct light at the OPC drum 13 to selectively charge or discharge the image regions thereof as is known in the art. At this time, the paper feed stepper motor 22 is energized to move synchronously with the drum motor 23, i.e., to accelerate to the same constant speed as the drum 13, and feed the paper to the point of image transfer 11. The paper is controlled to arrive at the point of transfer 11 simultaneously with the arrival of the first line of toned image on the drum 13 at the transfer point, with a slight margin such as a one millimeter leading margin. By re-positioning the web to the start position after each print in this manner and coordinating both position and speed of the web, applicant conserves paper 14 and minimizes the space between printouts, achieving zero paper loss and minimal margins.

Continuing with a process description, once the latent image is formed at a given line, the drum continues to rotate, the latent image is toned, and image transfer is started upon the simultaneous arrival of the front edge of the paper 14 and the initial lines of the toned image on the drum 13 at the transfer point 11. The drum is positioned opposite a transfer corona 12, and the web passes therebetween, thus transferring the toned image to the web and forming a real image print. The paper print continues to be fed at the constant peripheral velocity of the drum, and fixing of the transferred toner image on the paper takes place as the printout 19 continues and moves under a paper preheat lamp 15, and/or a flash fusing lamp 18, both of which are preferably activated in coordination with the paper feed. At the end of the printout 19, the drum 13 stops rotating, while the paper feed motor 22 slows the web speed and stops the end of the printed region 19 precisely at the severing location of a paper cutter 29. There, the printout 19 is cut with a small margin by the paper cutter 29, or optionally severed by the operator at a tear bar (not shown), and the fuser is then preferably de-activated. The controller then reverses the paper feed motor 22, returning the severed front edge of the paper web 14 to the start position 26, where it awaits initiation of the next print cycle.

Figure 6:
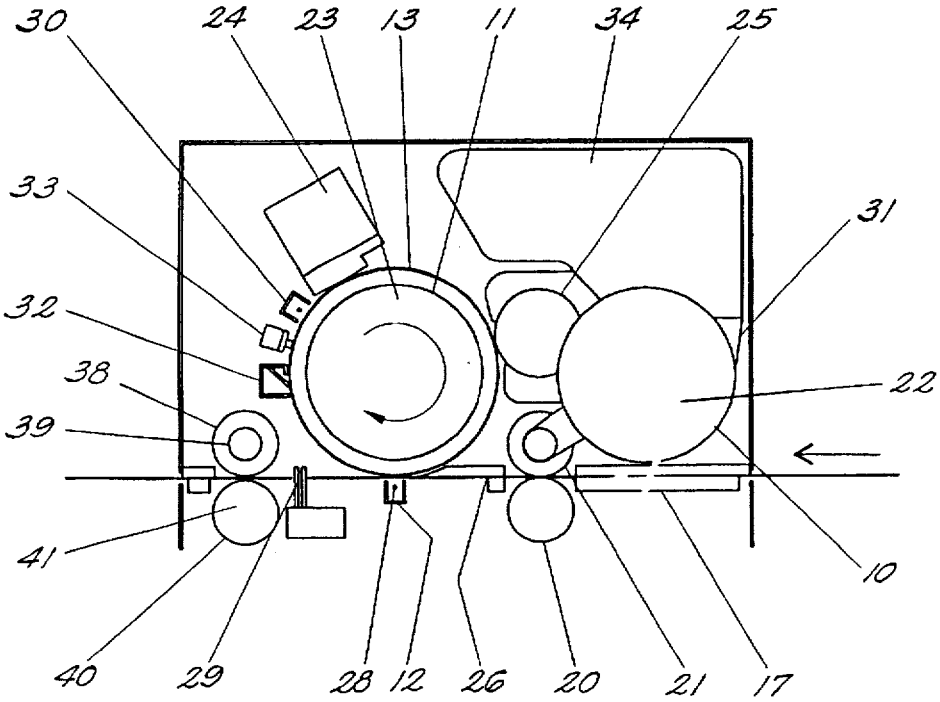
FIG. 6 shows a variation of the second embodiment having a hot pressure roll fuser.
Figure 9:
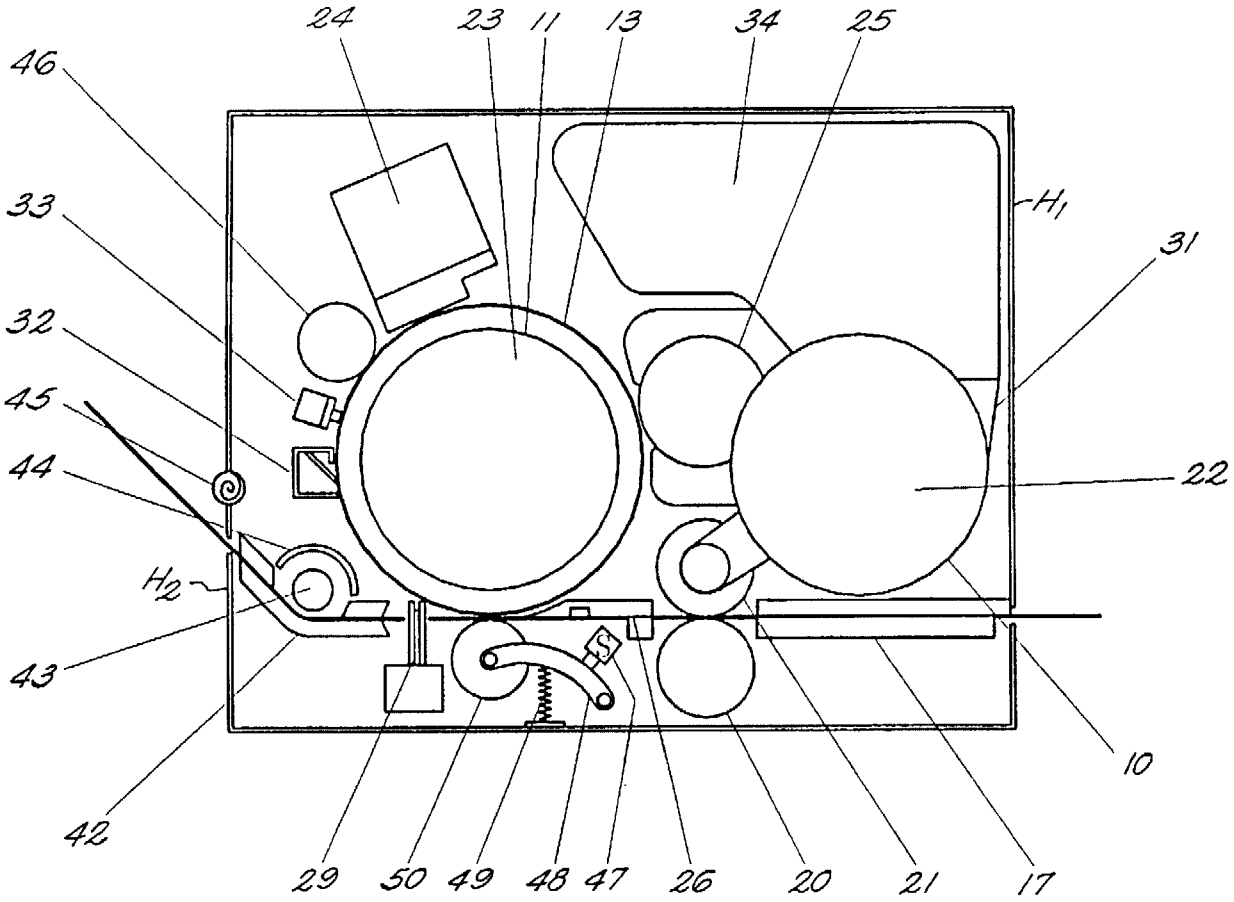
FIG. 9 shows an embodiment similar to that of FIG. 7, but employing a charged transfer roller.
Figure 11:
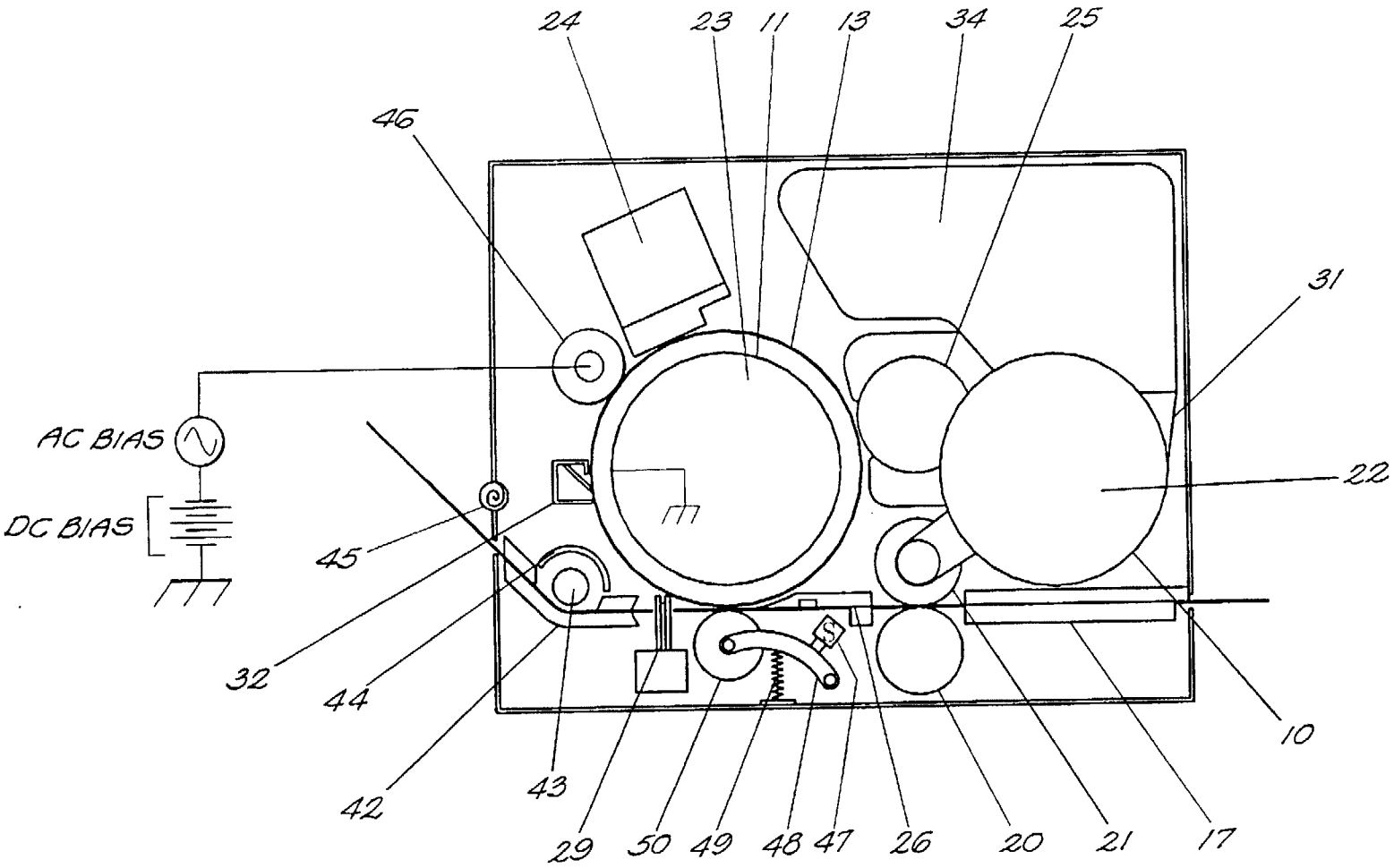
FIG. 11 shows an underneath path embodiment having a charged image transfer roller and a charging brush for charging the drum.
Figure 12:
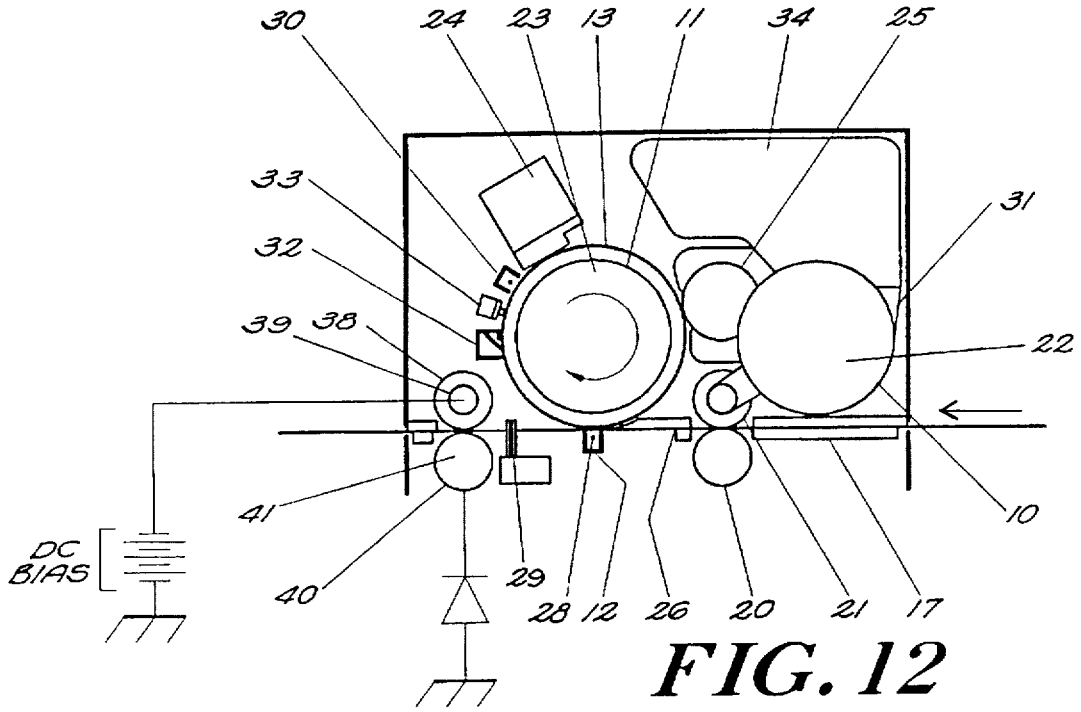
FIG. 12 shows an embodiment having a charged fusing roller.

FIG. 2 is a view of the printer shown in FIG. 1 with the drive motors removed to render other components visible. The latent imaging assembly includes a pre-charger such as a corona 30, or a charging brush or a roller charger 46 as shown in FIGS. 9 and 11, for uniformly charging the surface of the photosensitive drum 13, and a laser or LED optical module 24 for performing image exposure. A developing unit 31, such as a two-component, a magnetic one-component, or a non-magnetic one-component developer assembly develops the latent image, and a transfer mechanism such as a corona 12 similar to corona 30, or a charged roller 50 as shown in FIG. 9, which may be charged with an AC bias as shown in FIG. 11. Transfer corona 12 transfers the toned image from the photosensitive drum 13 onto the web 14. A cleaner such as a blade cleaner 32 or a fur brush cleaner (not shown), and a deelectrifying lamp 33 ( or the AC field of the pre-charger roller 46 as shown in FIGS. 9 and 11), are disposed at subsequent positions around the photosensitive drum 13, which may be an organic photoconductive (OPC) body, a Selenium or α-Silicon or other photoconductive body. Further along the process line, a thermal fixing unit 18 for fixing the toner image on the paper 14 with radiant heat ( or an assembly such as heated roller 38 and pressure roller 40 as shown in FIG. 6, which may be charged as shown in FIG. 12), is further provided on a paper-conveying passage along which the roll paper printout 19 is conveyed. By applying a DC bias between the opposed fuser rollers 38, 40 the web is able to travel at high speed while the toner remains firmly on the imaged paper surface.

Figure 10:
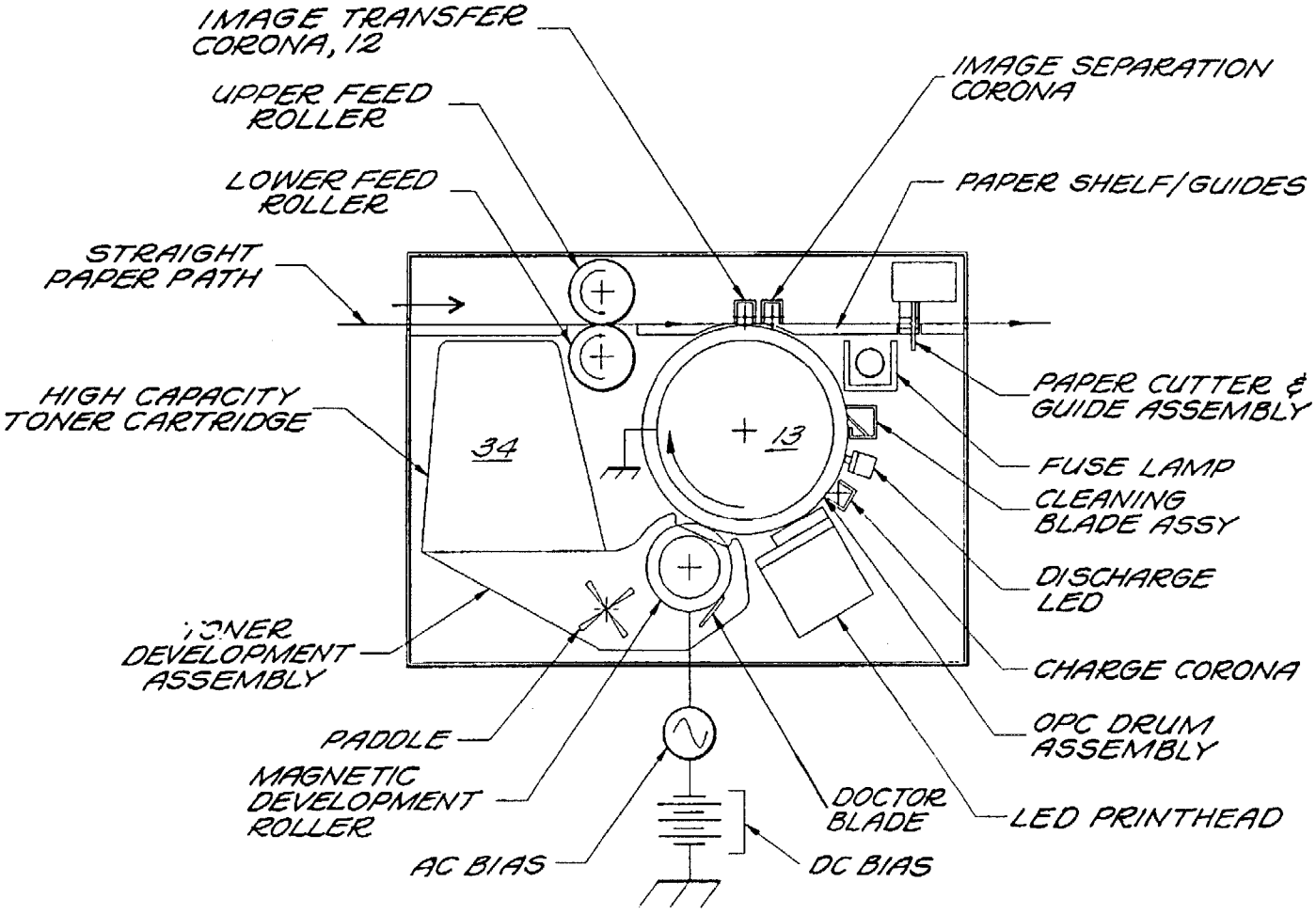
FIG. 10 shows another overhead path embodiment, having a paper separation corona.

The image forming operation is done in the following manner. First, the surface of the photosensitive drum 13 is uniformly charged by the pre-charger 30 and then the charged surface is exposed with an optical image by the laser or LED optical printhead system 24, thus forming an electrostatic latent image on the photosensitive drum 13. A high capacity toner cartridge 34 supplies toner to a developing unit 31 to develop the electrostatic latent image on the drum 13. The developing unit 31 preferably uses a one-component developer, and may, for example, have a paddle 35, a developing roller 25 and a toner spreading blade 36. The developer is stirred and carried to the developer roller 25 by the paddle 35. In the developing unit 31, the developing roller 25, which may have both a DC and AC applied electric field as shown in FIG. 10, comes in contact with the photosensitive drum 13, and the blade 36 restricts the thickness of a layer of toner on the developing roller 25 to a level effective to optimize print darkness and quality.

A transfer corona 12, or a charged roller 50 as shown in FIGS. 9 and 11, is disposed in the vicinity of the photosensitive drum 13 on the opposite side of the paper transport path, and serves as a counterelectrode to electrostatically transfer the toner image. A printout separation corona 37, or other electrostatic discharge device is preferably also positioned at the location shown in FIG. 13 to promote separation of the print from the drum 13 and assure that the web feeds without jamming into or along the paper channel. The toner image is fixed on the print 19 with heat applied to the toner image thus completing the printing process. In this embodiment, the print 19 is then severed from the paper roll 14 by a paper cutter 29 located across the web just after the transfer position 11, or by a tear bar (not shown). After the toner image transfer to the printout 19, the surface of the drum 13 continues to rotate, past a cleaner such as scraper 32 and/or a felt pad or cleaner roll, to remove the residual toner adhering to the drum. Next, residual charge on the drum 13 is removed by a deelectrifying lamp 33, or by the AC field of a precharger roller 46 (shown in FIGS. 9 and 11), causing the drum 13 to return to its initial non-imaged state, ready for another printing cycle of operation.

FIG. 3 is an end view from the right end of the printer mechanism of FIGS. 1 and 2, showing the overhead straight paper path with adjustable paper guides 16 and 17, image transfer corona 12, (or charged roller 50 in the embodiment of FIGS. 9 and 11), paper feed rolls 20 and 21, image transfer corona 12, toner image paper preheater 15, and flash fusing lamp 18. A high capacity toner cartridge 34 is connected to and feeds toner to the developer unit 31 by gravity, where blade 36 with the developer roller 25 coupled to the OPC drum 13, feeds a thin layer of toner to the latent charge image created by the LED printhead 24 on the drum.

Figure 4:
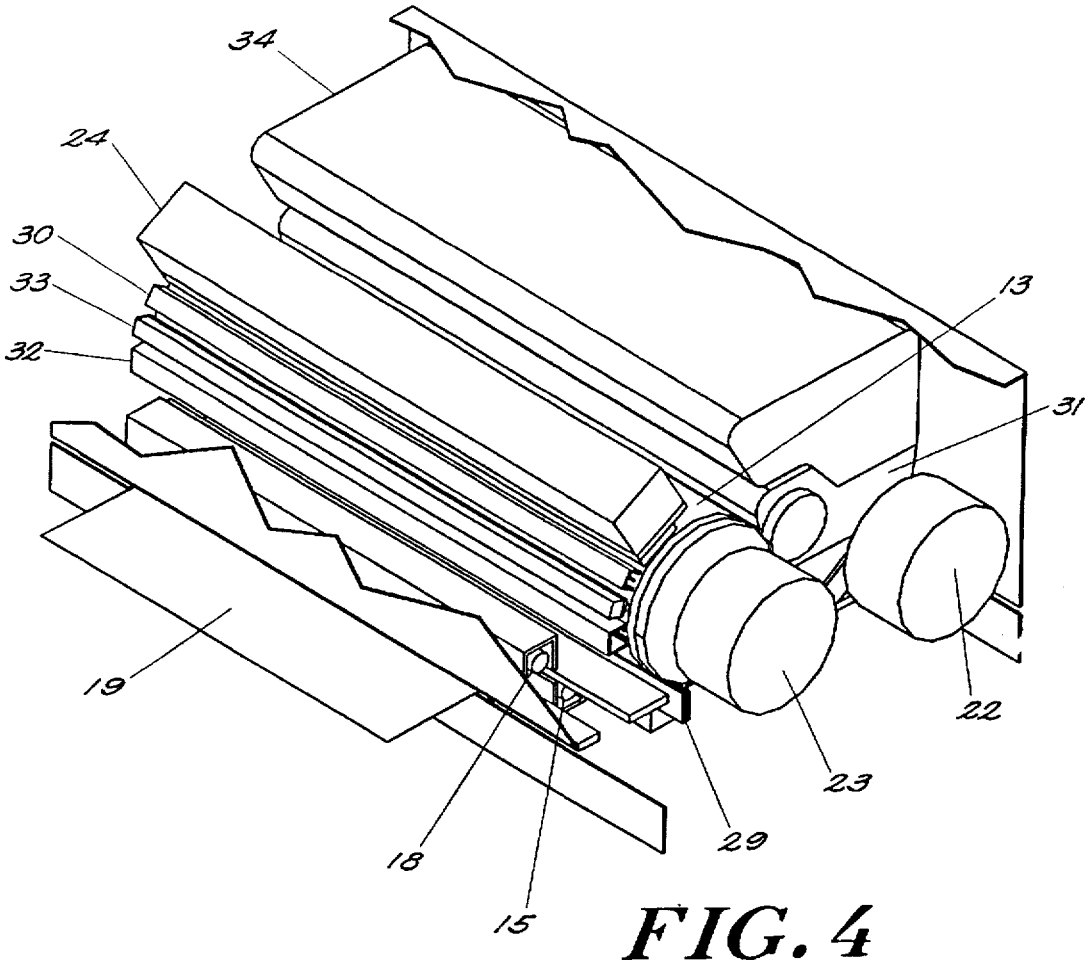
FIGS. 4 and 5 show a second embodiment of an on-demand narrow web electrophotographic printer of the present invention, having an underneath paper transport path.
Figure 5:
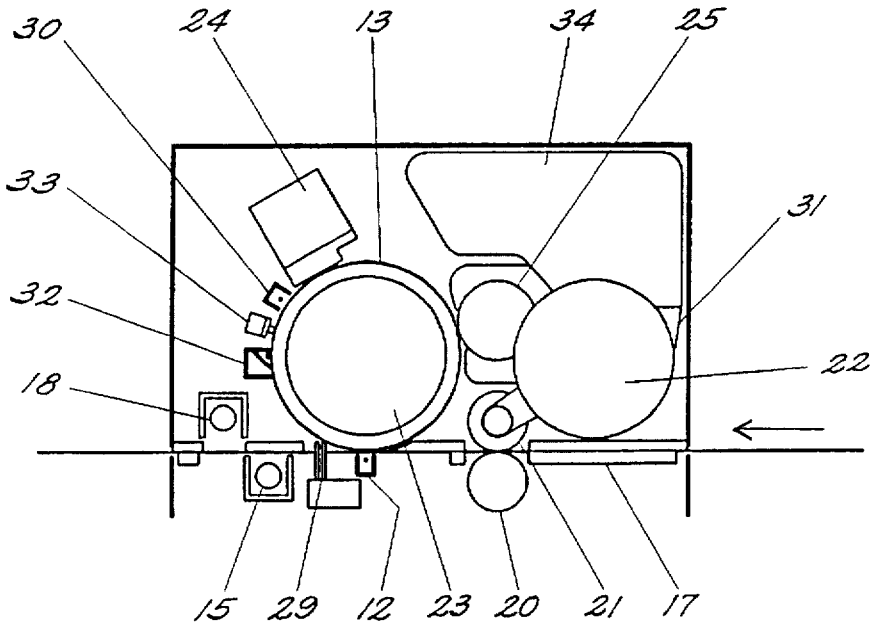

FIGS. 4 and 5 show another embodiment of an on-demand printer of the present invention, with similar printer components, numbered as in FIGS. 1–3, arranged for feeding the paper 14 under the print mechanism. This allows the printout 19 to follow a straight path, and to be viewed upright from above upon the completion of the print cycle. As in the preceding embodiment, the printout 19 may vary in length depending on the amount of data printed on the leading end of a continuous roll of paper 14, and the various feeding, imaging fixing, and cutting steps are carried out in phase with the image to achieve a complete print with a small margin.

A further embodiment is shown in FIG. 6. The basic structure of the printing apparatus of FIG. 6 is substantially equivalent in construction to that of FIGS. 4 and 5, except that the operation of fixing the toner image on the paper 14 is performed by a fixing roll assembly 38, 40. This apparatus includes a paper feeding mechanism 10 synchronized with an OPC drum imaging assembly 11 and an image transfer mechanism 12 that causes the toner image on the photosensitive drum 13 to transfer onto the paper at the point of image transfer 28 in the feeding path. However in this embodiment, a fixing roller 38 containing a heater 39 bears against a pressure roller 40 to fix the image on the printout 19 as it passes therebetween. As before, the printout is cut at the severing unit 29 near or at the end of the fixing process.

The feed rollers 20 and 21 are located near the position of an infeed opening adjacent to a supply paper roll. The feed roller motor feeds out paper between paper guides 16 and 17 from the paper roll and advances the paper 14 to the image transfer unit 12, and through the severing unit 29. The fixing roller 38 engages with the pressure roller 40 on the paper exit end of the feeding path and may be driven at the nominal speed of the paper feed by a separate stepper or other motor 41, or may be coupled to the OPC drum motor 23. As in the other embodiments, the drum motor 23 rotates the drum 13 at constant velocity, and the LED, laser, or other optical imaging device 24 selectively illuminates the OPC drum 13 to create the latent charge image pattern, which is toned by the development roller 25 with toner fed by the toner cartridge 34. It should be observed that because image transfer is effected by a corona 12, the web is positioned close to but out of contact with the drum 13, and thus drum 13 may continue to move and rotate un-toned portions of its surface past the transfer point as the web stops, is cut, or moves at a different speed or in a different direction.

As in the previous embodiment, at the end of a print cycle, the paper feed motor 22 retracts the front edge of the paper 14 which has just been severed by the unit 29, to the start position 26 is in front of the OPC drum 13. Since the spacing between start position 26 and the cutter 29 is fixed, such retraction is readily effected by driving the feed motor in reverse a fixed number of steps. At the start of the next print cycle, the front edge of the paper 14 is sensed by detector 27 at the start position 26 to verify its position, the OPC drum stepper motor 23 is operated to accelerate to the nominal paper feed velocity, e.g., six inches per second. Once at this constant speed, the imaging of the data by the LED 24 or other optical imaging system starts on the OPC drum 13, and the initial line imaging position provides a phase point or synchronization signal for the coordinated processes of paper feed and margin setting, i.e. the print transfer and web cutting synchronization. At this time the paper feed stepper motor 22 is accelerated to move synchronously with the OPC drum motor 23 before the point of image transfer 28 to the paper 14, and is controlled to bring the web to the point of transfer 28 simultaneously with the arrival of the toned image on the drum 13 at the transfer nip. Image transfer is started at the simultaneous arrival of the front edge of the paper 14 and the front edge of the toned image portion residing on the drum 13 at the transfer corona 12. The paper printout continues to feed at the peripheral velocity of the drum to ensure a high quality print image 19 with uniform line density. Fixing of the transferred image then takes place as the printout 19 moves between the fusing roller 38 and the pressure roller 40. These output rollers are preferably driven by a separate motor 41 at the same speed as the paper feed, or are coupled to the drum motor 23, for example, by a clutch, belt or direct mechanical coupling. At the end of the printout 19, the OPC drum 13 and the motor 41 stop rotating as the paper feed motor 22 slows the paper and stops the end of the printout 19 precisely at the severing location 29, where the printout 19 is cut with a small margin by a paper cutter 29. The motor 41 may then continue rotating to eject the severed print. Alternatively, the printout may be manually severed by the operator at a tear bar (not shown). The paper feed motor 22 then reverses, returning the front edge of the paper 14 to the start position 26, for the next print cycle.

Figure 16:
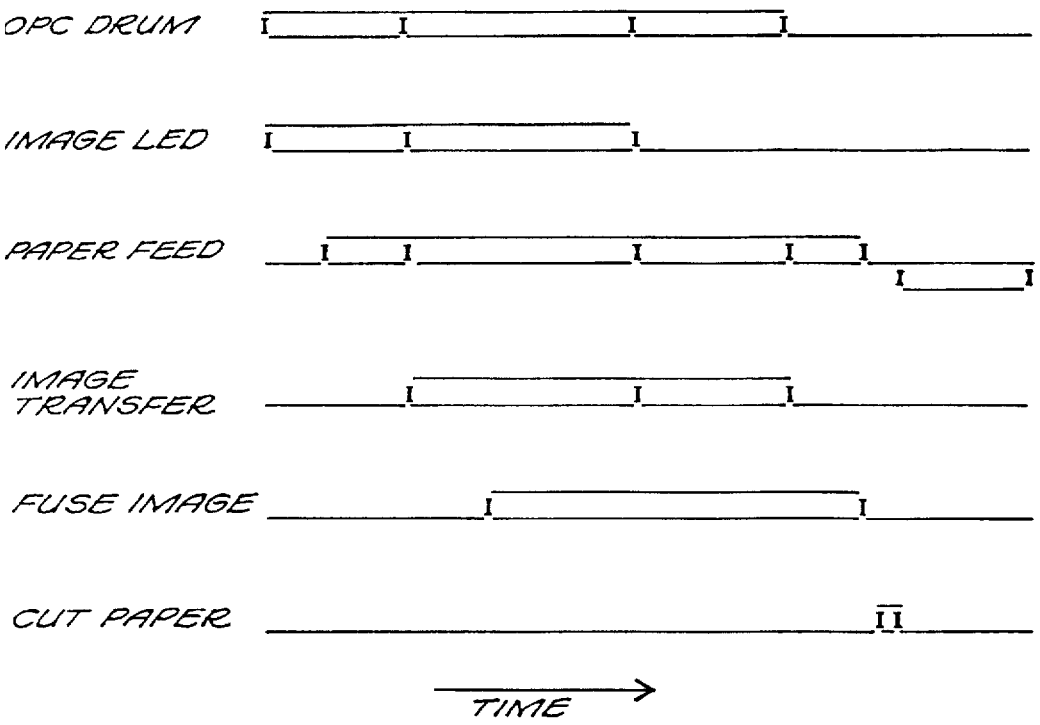
FIG. 16 shows timing coordination for operating the embodiment of FIG. 6.

FIG. 16 is a timing chart showing the periods of actuation of each of the drive or imaging components of the printer of FIG. 6, with the portion of the graph below the axis on line three of the FIGURE indicating a reversal of the paper feed direction.

When spherical polymerization toners with a uniform particle size and a one-component developer are used, the space between the paper 14 and the photosensitive drum 13 can be made quite small so that non-contact transfer of the toned image increases in efficiency. The improvement of transfer efficiency results because the transfer voltage is applied more evenly by the transfer corona 12. In this case, the corona charger 30 may be replaced by a rotatable brush charger 46 (shown in FIGS. 9 and 11) and the amount of the residual toner on the photosensitive drum 13 is quite small, so that the residual toner may be readily collected in the developing unit 31. Such a rotatable brush charger 46 scrapes the residual toner off the photosensitive drum 13, quenches the potential of the residual toner and uniformly disperses that toner on the photosensitive drum 13, allowing collection of the residual toner in the developing unit 31. Thus with this construction, it is possible to collect the residual toner without relying on or providing the separate cleaner unit 32 previously described in the post-imaging side of drum travel.

Figure 13:
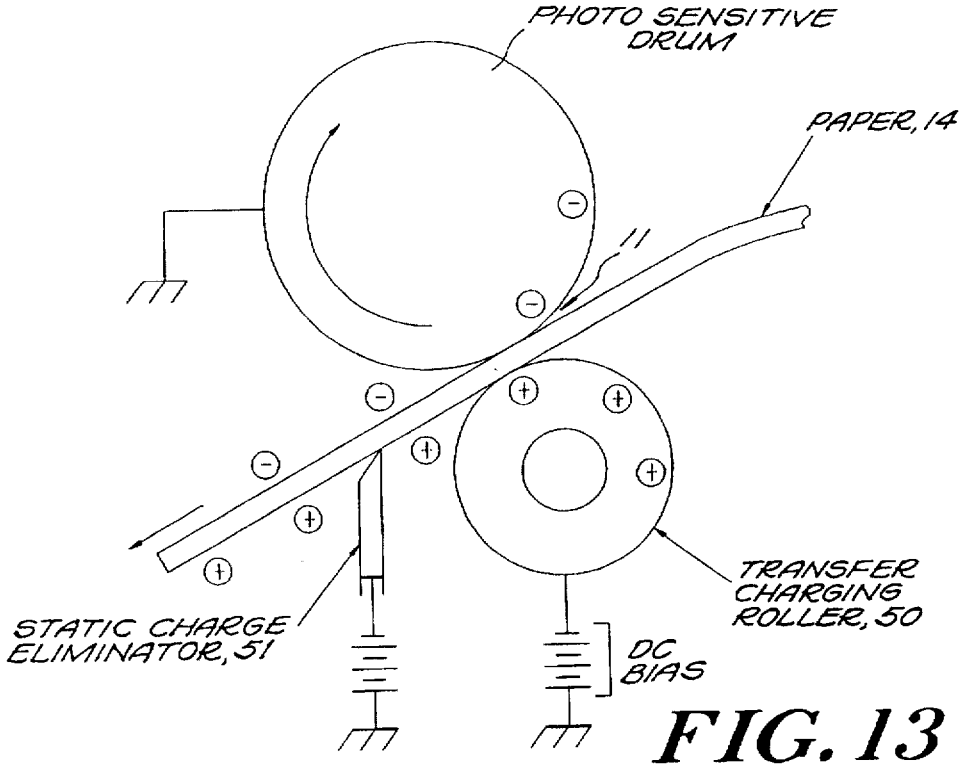
FIG. 13 shows a detail of the image transfer region useful in drum-transfer roll embodiments.

When a charged transfer roller 50 is employed as a counter-electrode to effect transfer of the toned image from the drum to the moving web, a charge eliminator 51 as shown in FIG. 13 is preferably placed proximate to the transfer station 11 to aid in preventing the web from adhering to the drum 13. This is readily implemented as a thin blade located proximate to the underside of the web and maintained at a fixed DC potential.

In the embodiment of FIG. 6, heat roller 38 and a backup roller 40 of the thermal fixing assembly for the printout portion of the feeding path function as a fixing unit to perform a function similar to that of the flash fusing unit 18 (which is preferred for non-pressure, high speed heat fixing), but they also provide an output drive which provides greater flexibility in the use of thinner web material which would otherwise need to be "pushed" through by the infeed driver or transfer roll. They also provide great flexibility in possible post-severing paper path configurations. The heated pressure roller 38 may also be operated with a paper preheater lamp like the preheater 15 of FIGS. 1–5 to increase the effective fixing rate and allow printing at higher speeds. Thermal contact fixing of the device shown in FIG. 6 provides heat and pressure to the printout 19 to fix the or fuse the toner image, and as noted above the hot fusing rollers, may also serve as the ejector to send the print along a discharge path. In this case the fusing rollers may be powered by a separate motor, and operated at a speed higher than the nominal web speed, once the trailing edge has past the imaging nip, to eject the final print. For example, a speed of about twenty inches per second is suitable for ticket ejection in a ticket printer. Alternatively, a solenoid may be actuated to eject a cut print if longer dwell in the fuser is desired, or only a radiant fuser is used.

Variations of the constructions illustrated in FIGS. 1 through 6 are achieved by substituting equivalent components and processes for various ones of those described. Thus, the invention includes equivalent arrangements in which the photosensitive drum 13 is charged by a brush charger replacing corona 30, and arrangements transferring the toned image from the drum 13 across the paper 14 by an image transfer roller 50 (shown in FIG. 9) instead of the transfer corona 12. When image transfer is completed by a transfer roller 50 with tangential contact to the drum 13 and paper 14 at the point of image transfer 28, it is preferred that some means for disengagement of the transfer nip also be provided, for example, that the roller 50 be spring-loaded into engagement and be retracted by a solenoid 47 which is activated at appropriate times to move the transfer roller away from the web. After the paper feed motor 22 completes the printout feeding between the photosensitive drum 13 and the transfer roller at location 28, the printout 19 carrying the transferred toner image is fused. The image-fixed printout 19 is stopped and cut or detached at the severing location 29. The front edge of the paper 14 may then be moved, as in the other embodiments, by the paper feed motor 22 to the cycle start position 26 with the transfer roller retracted.

FIGS. 7, 7A, and 8, 8A, 8B, respectively, show underneath and overhead path "clamshell" embodiments in which a housing H has upper and lower shell-like portions $H_1$, $H_2$ which pivot about a hinge 45 to open and close, and a line of drive and guide elements are carried by at least one half of the hinged housing shell. In each of these embodiments, a simplified fuser unit is shown including a reflector 44, heat flash lamp or halogen source 43, and an angled guide plate assembly 42.

Figure 8:
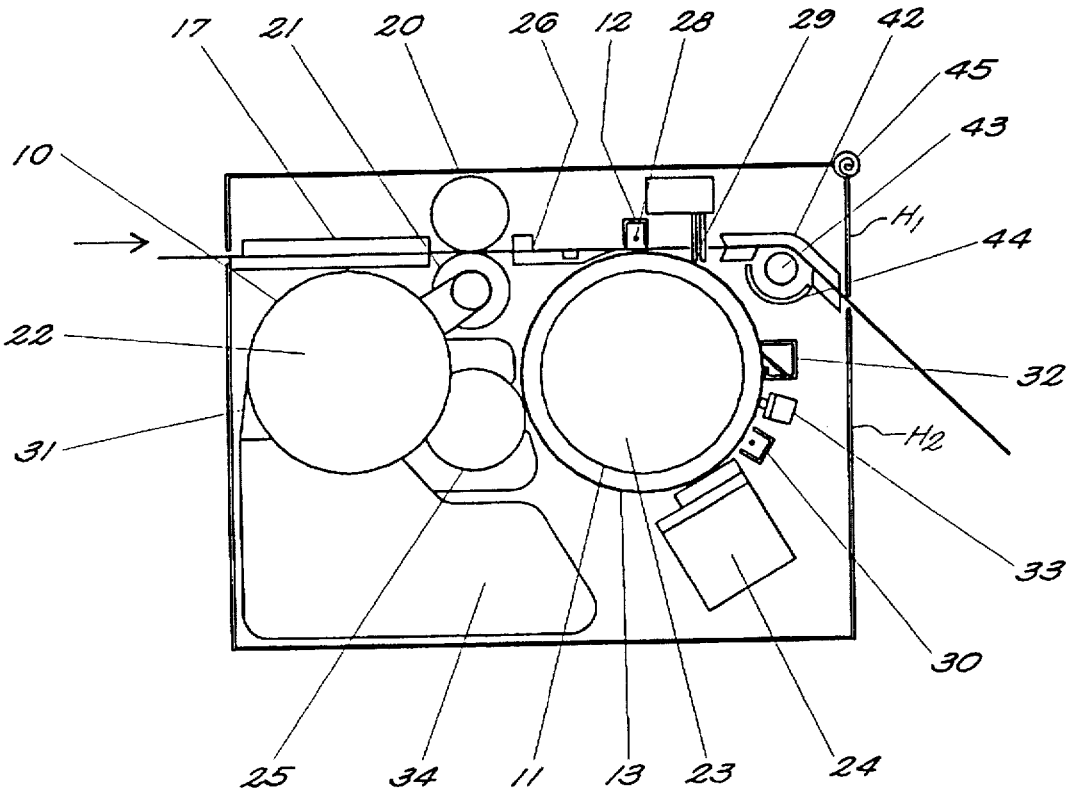
FIGS. 8, 8A and 8B show another overhead feed path embodiment, having a clamshell housing.
Figure 8A:
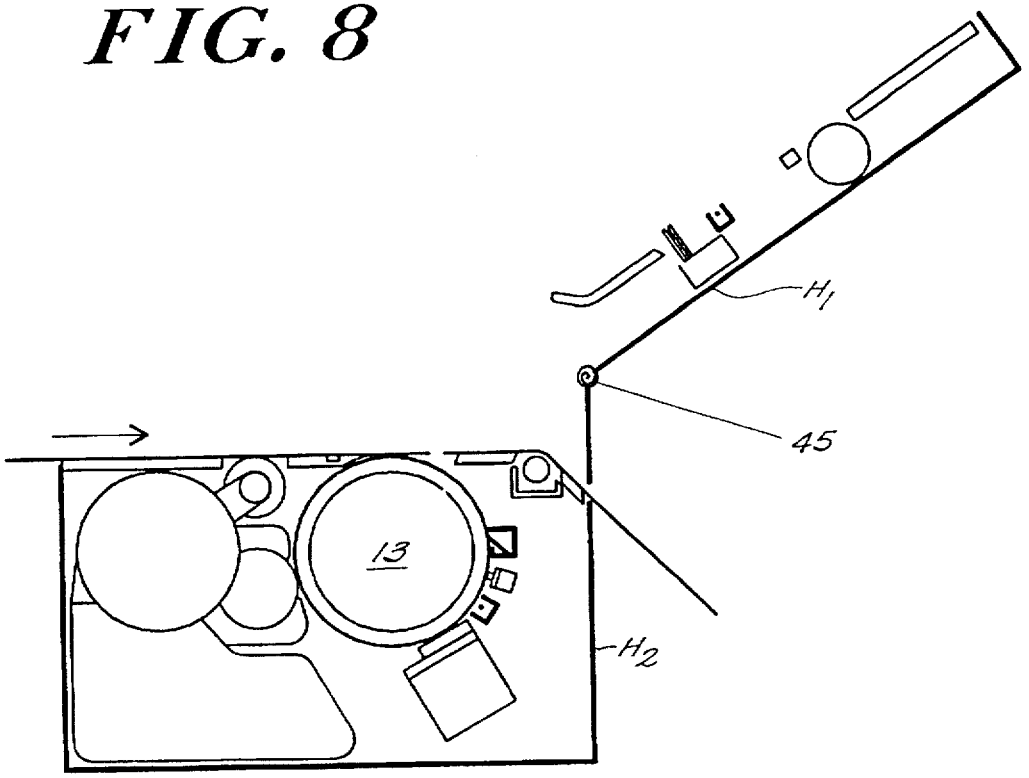
Figure 8B:
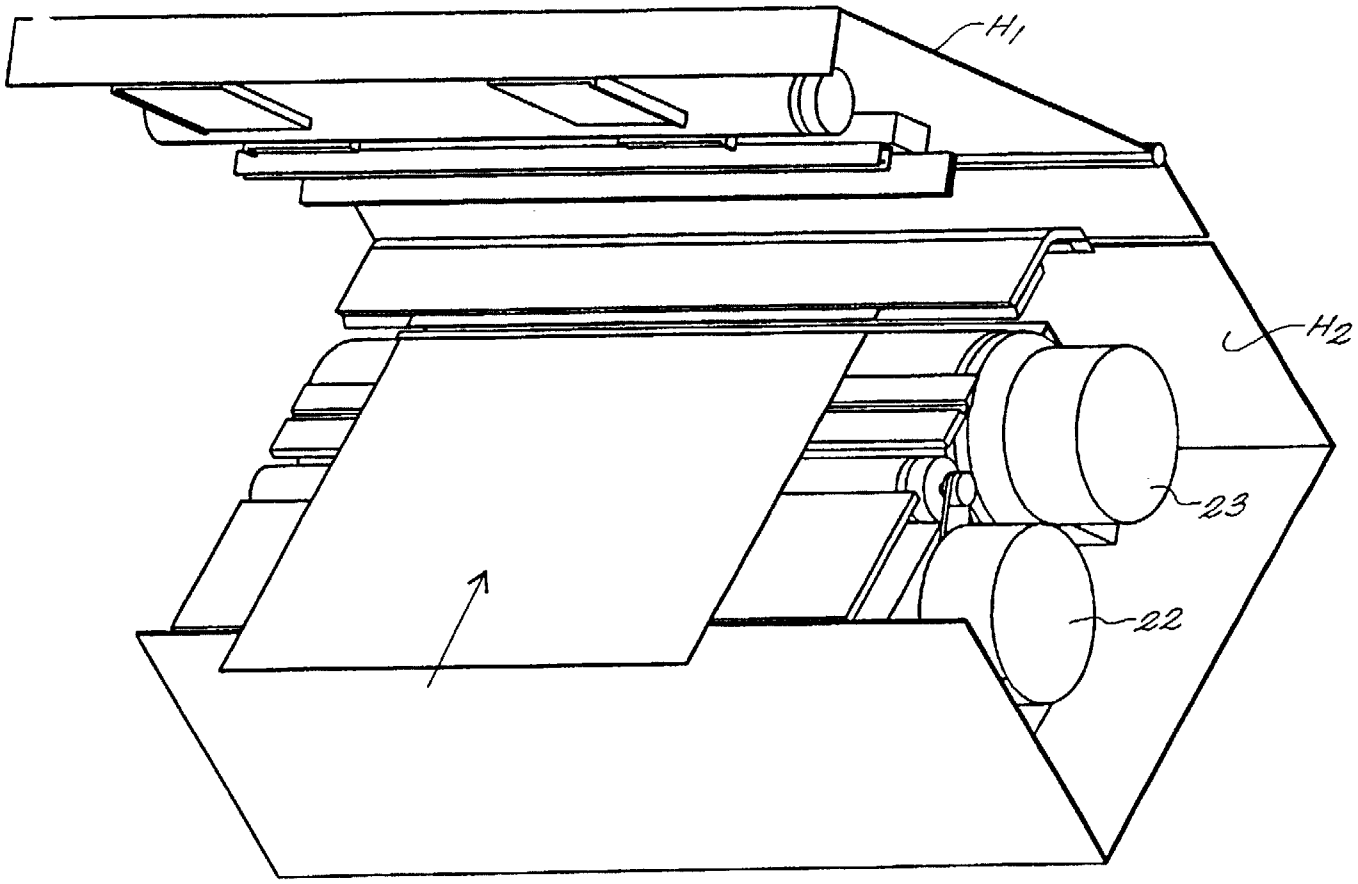

As seen in those FIGURES, the housing H swings open to expose the paper path, allowing the web 14 to be readily loaded by being laid across an open direct path defined, for example by the channel or tray defining plates **17*a* and roller 20 of the bottom assembly $H_1$ (FIG. 7A) and then firmly held in alignment by the corresponding drive or channel-defining elements 21, 17*b*, 26*b* in the top of the housing when it is closed. FIGS. 8, 8A and 8B show a corresponding clamshell configuration for an overhead-path printer of the invention. In this embodiment the paper feed direction is shown as left-to-right when viewed from the face of the printer on which the drum and feed motors 23, 22** are located. In general, the described architecture provides a high degree of flexibility in locating drive motors, solenoids, clutches and other mechanical drive couplings on right or left sides of the paper path, and these elements may be laid out to suit the shape or design of other functional mechanisms, for example external device structure when the printer is to serve as the output device of a cash register, a ticket-issuing console, or an automated teller or point-of-sale machine.

Thus, for example, in the embodiment of FIG. 10, no separate output drive is provided, and the cutter assembly 29 is positioned so close to the output opening that a completed print, once severed, hangs loosely to be manually removed. This is suitable for an ATM. In a ticket printer for items such as lottery tickets where it is common to print several different tickets consecutively, an output drive may eject each ticket in quick succession, or the controller may disable the cutter 29 until the last ticket is printed, leaving all tickets of a given batch connected in a strip.

Figure 14:
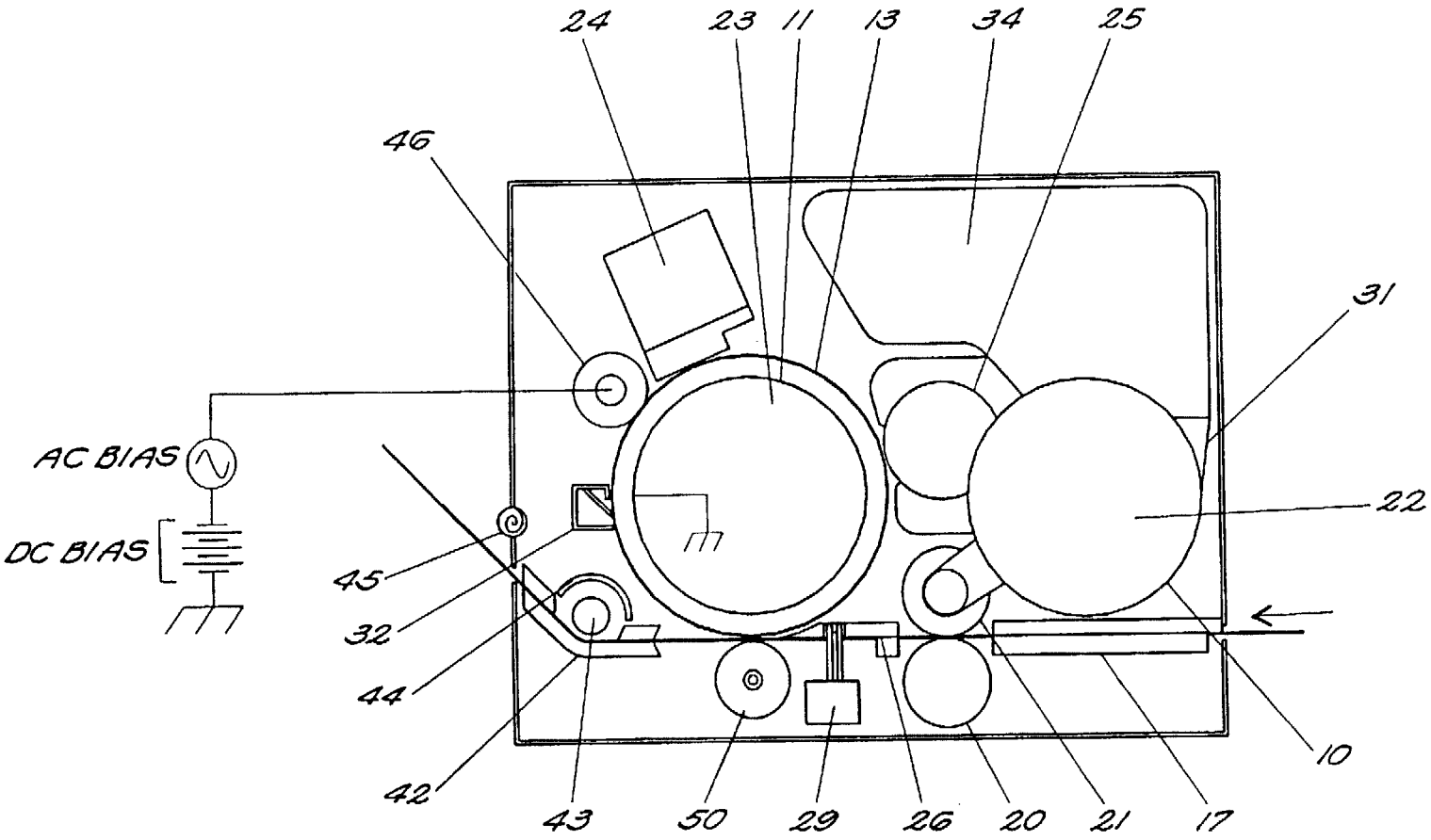
FIG. 14 shows an overhead path embodiment with a pre-imaging cutter assembly.
Figure 15:
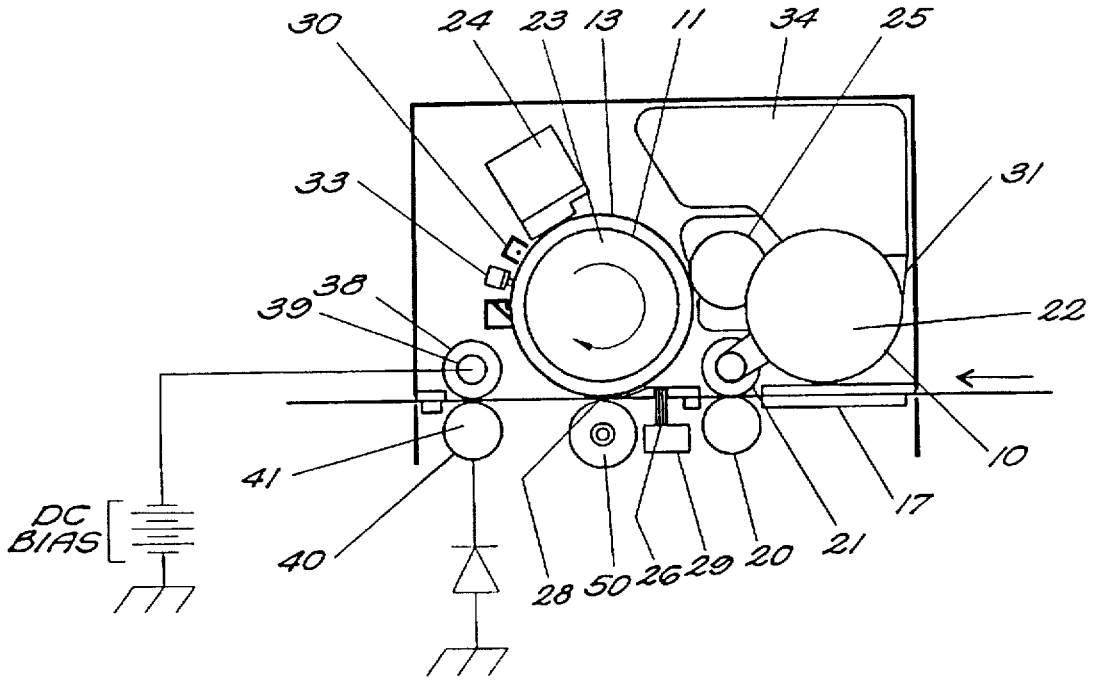
FIG. 15 shows a similar embodiment having output fusing rolls.

In other embodiments of the invention, the post-imaging severing unit shown in FIGS. 1–12 is replaced by a paper cutting unit 29 located at or near the cycle start position 26, as shown in FIGS. 14 and 15. This pre-imaging cutter 29 severs the web 19 at that location before printing is completed, and generally before any printing occurs. With this construction, entirely different coordination of the various subassemblies is effected.

In particular, with a severing point before the drum, it is not required that the image transfer roller 50 tangent to the point of image transfer at nip 28 be retracted from the drum 13 and the paper 14 in order to retract the feed web after cutting. Furthermore, no special control of the fuser is needed to prevent scorching when the web slows or stops for cutting, since fusing is performed only on the separated print, which moves continuously from transfer to output positions.

FIG. 15 illustrates one presently preferred embodiment of this aspect of the invention. For this embodiment, the paper cutting location 29' is located very close to the image transfer location 28 so that a very small printout margin is obtained without having to reverse the feed motor. In addition, the fuser rolls 38 and 40, and the transfer roll 50 may all be driven by or intermittently coupled to the drum motor mechanism 23, since in this construction no part of the print line requires a fully independent transport speed or direction. The paper feed rollers 20 and 21 may, however, be driven by a separate paper feed motor 22 or coupled through a clutch to the drum motor mechanism 23 so that they may be intermittently stopped.

Figure 17:
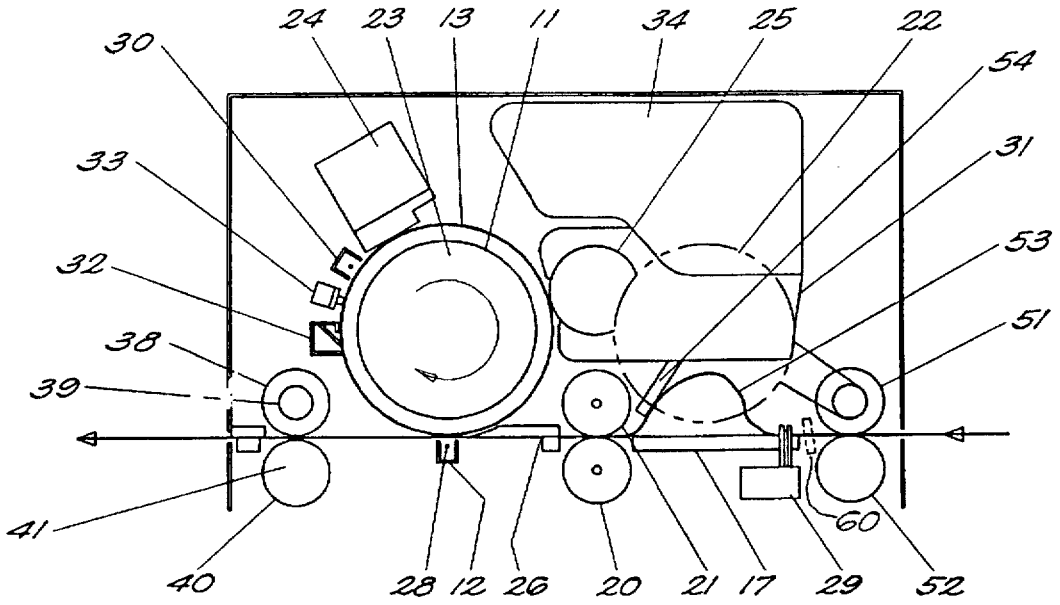
FIGS. 17 and 17A show construction of a preferred embodiment with a pre-imaging cutter assembly, and illustrate timing coordination for operation thereof, respectively.

Another, further preferred embodiment utilizing such a pre-imaging cutter applicant is shown in FIG. 17. This embodiment achieves a unidirectional zero-paper loss printing while further significantly relaxing constraints on cutter location and system coordination.

Figure 17A:
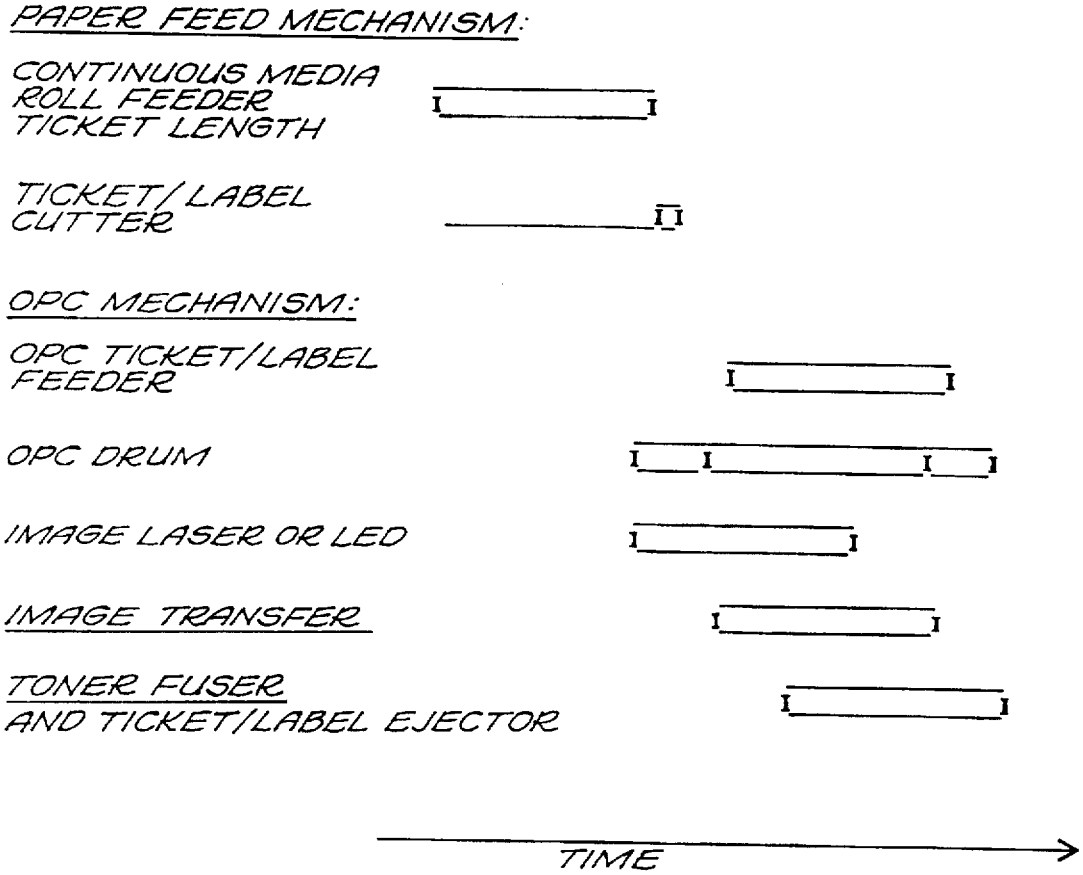

In this embodiment two sets of infeed rollers are provided, a first set 51, 52 which draw the web in from a paper supply roll, and a second set 20, 21 which feed the paper along the transport channel that defines the start position 26 and past the drum 13. A staging area is defined between the two sets where excess paper may accumulate. The cutter 29, which may be a rotary knife or other known cutter assembly, is located between the two sets of feed rollers, and the rollers are operated so that the incoming web maintains a feed loop 53 ahead of the feed rollers 20, 21. As best seen in FIG. 17A, the feed loop 53 is an unconstrained loop of material built up or maintained between the cutter knife and the image feed rollers 20, 21, approximately doubling the length of web accommodated at this position. The loop accommodates a variable length of web material which is calculated to receive the image being transferred from the drum 13. Once the cutter 29 has severed the paper, feed rollers 20, 21 draw the loop forward and feed it along the paper transport tray and past the drum transfer assembly 12, where it is picked up and further drawn onward by the fuser/paper ejector rollers 39, 41. In general, when the ticket length is variable, as is the case for receipts, the length of material to be fed past the cutter 29 is the length of the printed matter (the "process length") plus the leading and trailing margins. In this embodiment, the controller includes a memory that tallies the electrographic print line data going to the laser imaging unit 24. When the "process length" is known, i.e. when the last print line has been recognized the controller computes the desired ticket length and activates knife 29 at the appropriate instant. The feed loop 53 thus allows the infeed rollers 51, 52 which count the amount of web fed past knife 29, to be operated synchronously with respect to rollers 20, 21 which count the material fed past the start position 26, and which must also operate at a constant speed. Furthermore, the distance from start position 26 to knife 29, including the feed loop may be configured to be no greater than the circumferential distance from the image exposure station 24 to the image transfer assembly 12, so that the cutter 29 is readily activated to cut the web at a position which exactly fits the print. Thus, a print of arbitrary length is formed, such as a lengthy cash register receipt, and is severed at position 29 to achieve minimal margin (zero loss) printouts. Alternatively, a print buffer may be provided, which keeps track of the lines to be printed. The print line buffer has a sufficient size that the end-of-print position is known before the web has fed past position 26, or when the length of image not yet transferred to the web is greater than the transfer print-to-cutter distance. In that case, simple counter logic applied to the buffer memory determines when to activate knife 29 to achieve the specified trailing margin.

Figure 18:
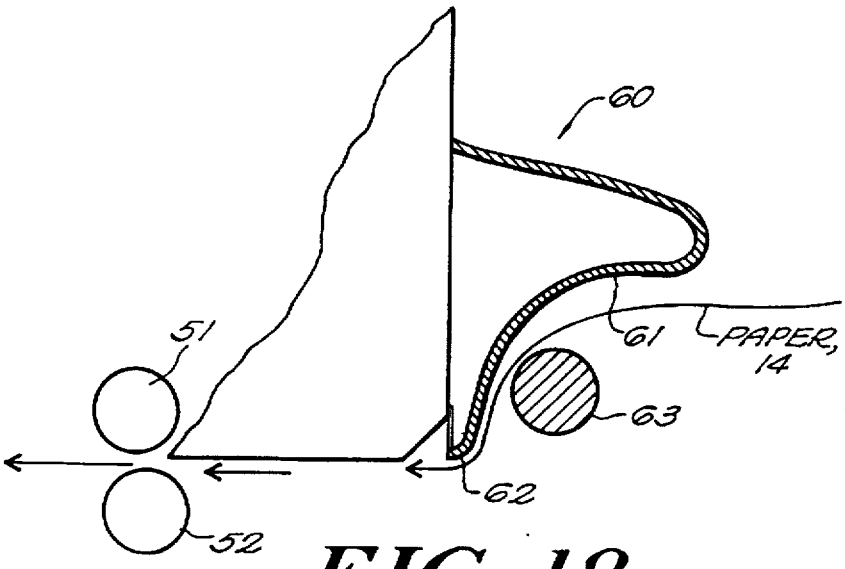
FIG. 18 shows a paper decurler useful in all embodiments of the invention.

As schematically shown in FIG. 17, a paper decurler 60 is preferably located ahead of the knife 19. Narrow web materials may be wound on a small core, and as the paper roll unwinds, portions of progressively smaller diameter are fed along the web path. This paper has a high degree of curvature, and the decurler is provided at the infeed to draw the incoming web over a projecting bar 62 and decurl the paper. FIG. 18 illustrates a simple and effective decurler 60 which, as illustrated, includes a passive protruding wedge located ahead of the first infeed rollers, so that the rollers pull the web under tension over the narrow edge thereof. The localized high bending stress then relaxes or disrupts the acquired curl of the web, and renders it straight, greatly reducing the possibility of misfeeds as the web is subsequently cut, pushed or pulled along the print path past the transfer point. A preferred implementation of this decurler assembly further includes a curved guide 61 which extends around a pin or cross piece 63 to define a paper entry path holding the paper in a narrow inlet region leading to the decurler. The decurler itself is a smooth-surfaced projection 62 of small radius about which the paper turns abruptly to enter the main feed path of the printer. Preferably, the supply roll itself, or a pair of idler rollers ahead of the decurler, has a frictional brake, so that a mild tension is established in the web being drawn in by the infeed rollers 51, 52. This causes the web to bear against the decurler 62 with a force sufficient to dissipate its acquired "set" or curvature. Other forms of decurler may also be employed, such as a saddle-surface which contacts the web, or a plurality of opposed conditioning rollers of small diameter positioned in close alternation along the feed path.

All of the forgoing embodiments enjoy a paper path which is not only short but straight, however the invention is not limited to such embodiments. Where external constraints require, embodiments of the invention may be configured to have the operative print line elements arranged along a path that curves or turns between one operative portion and the next. For example the elements may be arranged to accommodate a side-entry paper supply and a vertically-oriented printer output.

Figure 19:
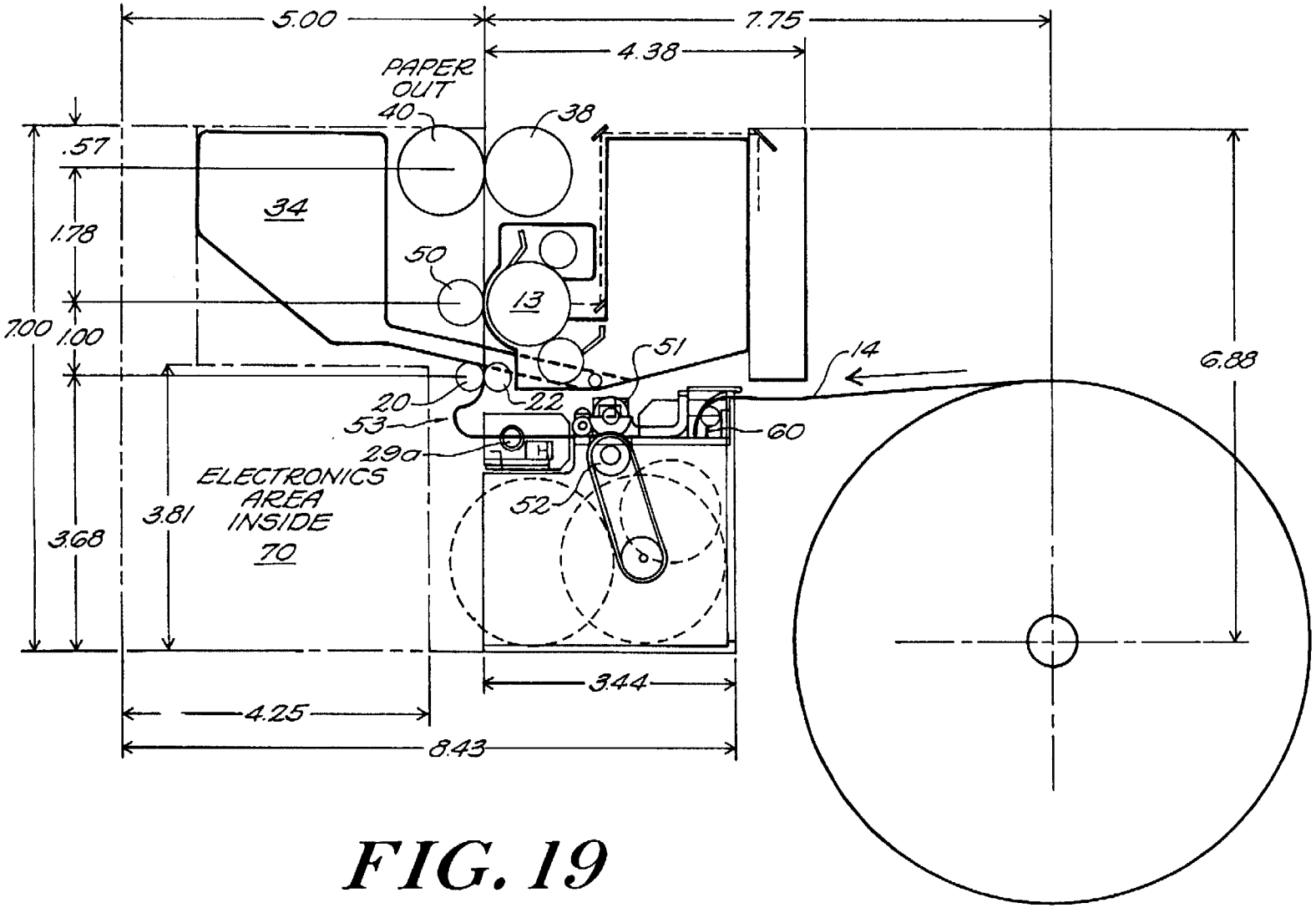
FIG. 19 shows a compact embodiment of the invention configured with an L-shaped paper path.

Such an embodiment is shown in FIG. 19. As shown, the paper web 14 is drawn in horizontally by infeed rollers 51, 52 and travels through a rotating slot cutter **29*a* curving up to the second set of feed rollers 20, 22, thereafter following a vertical path past the remaining image forming stations. As in the embodiment of FIG. 17, a slack loop 53 is formed between the two sets of infeed rollers, past the cutter position. Retractable edge guides, not shown, may be provided to guide the severed paper leading edge to the rollers 20, 22** after each operation.

The foregoing discussion has assumed without specific description that electronic line data is provided to the printer to produce its images, and that the line synchronization signals from such line data are generally available to the controller, which otherwise receives position and speed data from the position sensors and the drive stepper motors, respectively to coordinate motion of the web, actuate corona or fuser elements and otherwise determine its control actions. FIGS. 16A and 17A illustrate, by way of example, the actuation or time lines for operation of each active component in the printers shown in FIGS. 6 and 17, respectively, as narrated above.

Certain generally applicable technology will be understood to be used for implementing various known operations. In this regard, all embodiments may utilize discrete components as described below.

The invention contemplates printers with a communication adapter for LAN or the like, a hard disk drive, a floppy disk drive, or other memory components, allowing storage, transmission or reception of print data which is applied by the imaging module.

A printer with a roller brush charger unit 46 may achieve a cleanerless construction (one that does not include a cleaner 32 to collect the residual toner on the photosensitive drum 13) thus constituting a printing mechanism of reduced size.

A photosensitive material, such as an organic Selenium or a-Silicon photosensitive body, may be used for the photosensitive surface of drum 13. The roller brush charger 30 if used may be a brush charger which has a conductive brush shaft with a diameter of less than 16 mm covered with conductive straight fibers. (e.g., "Lec," a product of Unitika Ltd.), and may, for example, be energized with an AC voltage with a DC offset of −650 V and a peak-to-peak voltage of 1.2 KV at a frequency of 800 Hz. This brush charger 30 evenly charges the photosensitive drum 13 so that the surface potential of the OPC drum 13 becomes about −650 V. Instead of such a charging brush, a charging roller, a Corotron, a Scorotron, a charging solid, or a flat type charging brush (fixed brush) 46 may be used to replace the corona charger 30.

The photoconductor material of the drum 13 may be heat resistant to permit preheating the recording medium and allow faster toner fusing. Such a heat resistant photoconductor may be selected from among materials such as a silicon, a zinc oxide, or an organic photoconductor; preferably the photoconductor has a binder having glass transition point of not less than 100° C.

The toner preferably has a low melting temperature to permit faster fusing and higher overall printing speed. The low temperature toner may be an encapsulated toner produced by interfacial polymerization with a melt temperature of 80° C. to 120° C.

The optical unit 24 exposes the evenly charged photosensitive drum 13 to a light image to form an electrostatic image thereon. This optical unit 24 may be electrophotographic or electroluminescent (EL) element (as sold by Stanley or by the Norma Co. Ltd.). A solid light-emitting element, such as a LED array, or the like may also be used as the optical image writing unit 24.

The developing unit 31 is preferably a one-component developing unit that uses a one-component developer. This developing unit 31 has a developing roller 25, which rotates around a metallic shaft to supply developer to the electrostatic latent image on the photosensitive drum 13. The preferred developer is a one-component toner of a non-magnetic and insulating resin. Toners such as polyester toners having a volume resistivity of $4\times10^{-14}$ Ohm-cm and an average particle size of 12 micrometers, with 0.5% of a silica additive are suitable.

The developing roller 25 may be a porous urethane sponge (product name "Rubicell" available from TOYO POLYMER Co., LTD.) with an average pore size of 10 micrometers, about 200 cells per inch, a volume resistivity of $10^{-4}$ to $10^{-7}$ Ohm-cm and a hardness of about 23 (as measured by an Ascar C penetrometer). The developing roller 25 rotates at a peripheral speed 2.5 times that of the photosensitive drum 13. This developing roller 25 is preferably biased with a developing bias voltage, typically several hundred volts positive with respect to the surface potential of the photosensitive drum 13 of minus 650 V. The contact pressure of the developing roller 25 to the photosensitive drum 13 is three grams/mm.

A layer-thickness restricting blade 36 restricts the thickness of the toner layer on the developing roller 25 to a given maximum thickness and charges the toner particles with a predetermined amount of electric charge. This layer restricting blade 36 is a stainless plate of a thickness 0.1 mm with a tip portion rounded to a radius R=0.05 mm. The pressure of this blade 36 against the developing roller 25 is set to 35 g/cm.

A voltage of −100 V is applied between the layer-thickness restricting blade 36 and the developing roller 25. This reduces the variations in the amount of charge of the charged toner with changing environmental conditions, and ensures long-lasting stable charging conditions. As toner passes between the developing roller 25 and the layer-restricting blade 36, therefore, charge is imparted to the toner by frictional charging caused between the toner and the blade 36. At the same time, the voltage between the developing roller 25 and the layer-thickness restricting blade 36, supplies charge to the toner particles from the blade 36. That is, the toners are supplied with charges by triboelectronic charging as well as the latter specific bias supply of the charge. Therefore, both environmental dependent variations and time-dependent changes in the amount of charge on the toner becomes small, thus ensuring a stable amount of charge and relatively uniform toning conditions.

The preheating lamp 15 may heat the recording medium up to 160° C., and any type of heat source can be used, including quartz or flash heater elements.

When flash fusing lamps 18 are used for fusing, these may operate at a power in the range of 150 to 500 watts to fuse the printout 19 at the rate of 4 to 6 inches per second, operating at 120 to 480 cycles per second and a 20 microsecond to 2 millisecond pulse width at 400 joules per pulse. Appropriate Xenon pulsed lamps 18 include General Electric PXA-44 and EG&G FXQ-81-4 lamps. The lamp reflector may be a 0.38 to 1 inch diameter semicircular design made from Alvac reflector material. Pulsed lamp power may be provided by a modified Analog Modules, Inc. Power Supply 576-1.5-2-115F. with dimensions 4.75"×5.76"× 3.25". Alternatively, when fusing is done between heated pressure rollers, a separation claw, i.e., an array of spring-loaded fingers, may press against the roll to keep the paper from adhering and to strip the front edge from the hot roller.

The present invention is not limited to the above embodiments, but may be modified in various manners as follows. First, although the present invention has been explained as a printing apparatus, it may be a different type of image forming apparatus, such as a copying machine or facsimile output device. Secondly, although the print process has been explained as an electrophotographic mechanism in the foregoing description of the embodiments, other printing mechanisms which transfer a toner image may also be used, such as direct printing, toner array imaging, thermo-magnetic, thermal-laser, electrostatic, and magnetographic printing. Furthermore, on-demand and continuous form rolls, cut sheets, and fan-fold media are not limited to paper, but may include other media. The photosensitive drum 13 may be replaced by an endless belt imaging member. The charging means is not limited to a corona or transfer roller 30, but may include an endless transfer belt or a transfer charger. Also, pressure-heat or radiant heat fixing may be combined with image transferring to simplify the print process. In addition, although the optical unit 24 is preferably an LED exposure system, the optical imaging steps can be accomplished by a laser optical system, a EL(electroluminescent) optical system, a liquid crystal shutter optical system or the like. Although the developing unit 31 preferably uses a non-magnetic, one-component developer, another known method, such as two-component magnetic brush development or magnetic toner development may be used. This print process may also be implemented as a cleanerless process, i.e. one that uses no cleaner to collect the residual toner from the photosensitive drum 13, thus making the print process compact. Also, the apparatus may be placed upright or in any orientation using stands or the like to improve stability. Further, although the printout 19 is designed to be detachable, it may remain attached as in continuous form printing and be detached outside the print cycle. In that case, the cutting mechanism need not be in the printer, and steps identified herein as cutting steps, are instead simply margin-determining steps which are used to synchronize printhead actuation without actually severing the web between steps. Further, the paper roll may take the form of a special paper cassette and the media may be fed in a different manner to the OPC drum.

After the drum is physically cleaned, it is conditioned by applying a uniform negative charge across the surface of the drum with the primary charging roller, which may be located in a cartridge assembly containing the drum 13. The primary charging roller is coated with conductive rubber, charged with an AC current which erases any residual charges, and produces a uniform drum surface potential as shown in FIGS. 9 and 11. The AC current is centered around a negative DC bias which may be changed by a print density controller in a manner known in the art.

During the image transferring process, the toner image on the drum surface is transferred to the passing web, for example, by applying a positive charge applied to the back of the media by the transfer roller, to cause the negatively charged toner particles on the drum surface to be attracted to the media. In general, the small diameter of the drum 13, combined with the stiffness of the media cause the media to separate easily from the drum. However, static eliminator teeth may also be provided to help separate the paper from the drum by weakening attractive forces between the negatively charged drum surface and the positively charged paper. Such a component is preferably used when necessary to keep thin media from wrapping around the drum.

The developing process changes the latent electrostatic image into a visible image by depositing negatively charged toner particles on the exposed areas of the drum. The developing roll may be, and preferably is, located outside the toner cartridge, and may consist of a metallic cylinder that rotates around a fixed magnetic core.

As shown in FIG. 10, the developing cylinder is charged with an AC current that is centered around a negative DC bias. The AC current improves density and contrast by decreasing the attraction between the toner particles and the magnetic core or the cylinder. This increases the repelling action of the toner against the areas of the drum not exposed to laser light. The negative DC bias applied to the developing cylinder preferably varied by a print density controller which may be a manual adjustment made in response to view the print density, or may be an automated control as known in the art. Preferably, both the primary charging roller and developing cylinder DC bias voltages are changed in response to the density setting of the controller. These changes in DC bias cause either more or less toner to be attracted to the drum, thus increasing or decreasing print density.

The toner is a powdery substance made of black plastic resin bound to iron particles. The toner particles are attracted to the magnetic core of the developing cylinder. A rubber blade "brushes" the toner on the developing cylinder to a uniform thickness.

The toner particles obtain a negative static charge by rubbing against the developing cylinder which is charged with a negative DC bias. For the described embodiments, the negatively charged toner is attracted to the discharged (exposed, more positive) areas of the drum, and repelled from the negatively charged (non-exposed) areas.

The fusing steps bond the toner particles into the media with a heated fusing roller and a soft pressure for single sheet paper rolls.

The fusing roller may contains two or more quartz-halogen lamps (not shown) that provide heat for the fusing process. The fusing temperature is monitored by a DC controller, with a temperature sensing element such as a thermistor (not shown). The DC controller may maintain a temperature of about 190° C. during print mode. If the fusing system overheats (e.g., above 230° C.), the control circuit reduces or interrupts power to the fusing heater. If the fusing system exceeds a higher threshold (e.g., 240° C.), the thermal fuse opens, cutting all power from the fuser assembly.

Figure 7:
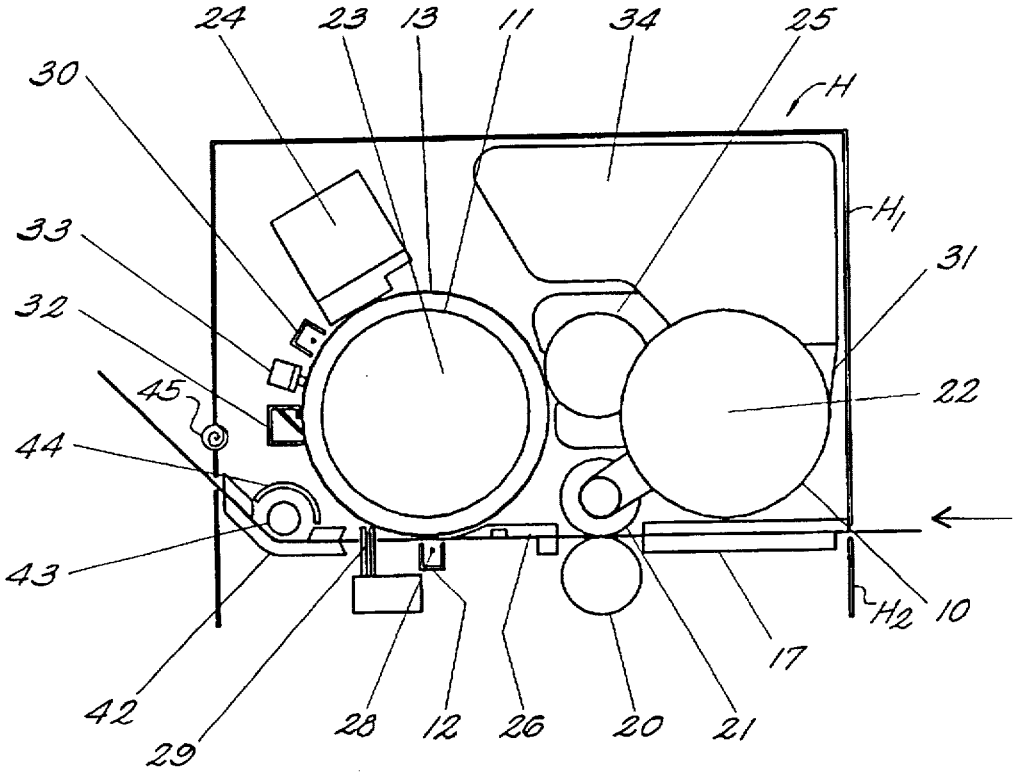
FIGS. 7 and 7A show another variation of the second embodiment, with a radiant heated fuser and a clamshell housing.
Figure 7A:
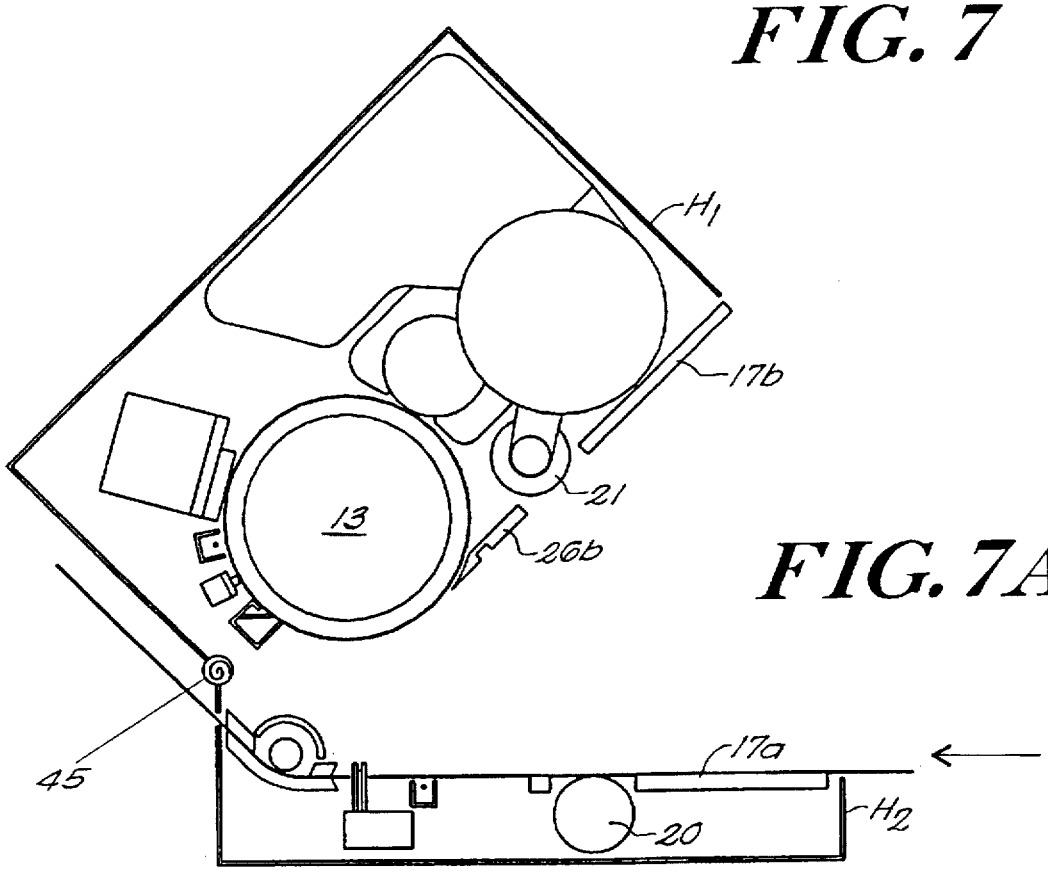

The devices of FIG. 7 and FIG. 8 with paper paths for bottom and top paper feed paths respectively, are especially well adapted for applications such as lottery ticket printing and ATM transaction receipt printing, as they provide a high degree of clearance about the unit with compact output paths to produce a face up or face down printout. Cut printout ejection solenoids and paper feed rolls are not shown, but are readily configured by those skilled in the art.

The invention being thus described and illustrated, variations, modifications and equivalents will occur to those skilled in the art, and all these variations, modifications and equivalents are, intended to be within the scope of the invention, which is defined by the claims appended hereto.

What is claimed is:

1. A printer for tickets, labels or the like, such printer comprising a transport assembly defining a path having an inlet and an outlet, the inlet receiving a narrow web of print medium having a leading edge, and also including feed means for feeding said web along the path from said inlet an electrographic imaging assembly positioned along said path between the inlet and the outlet, said imaging assembly including an imaging member adjacent an imaging position on said path means for forming a latent charge image on said member means for developing the latent charge image on said member with a toner to produce a toned image, and means for transferring the toned image to said narrow web as the web is fed past said imaging position fixing means for fixing the transferred toned image as a print on the web cutting means for severing a portion including said print from remainder of said web with a single cut, said cut thereby defining a trailing edge of the print and a new leading edge of said remainder of the web, and control means for controlling said transport assembly, said imaging assembly and said cutting means so that the print is formed with fixed leading and trailing margins without wastage while unidirectionally transporting said web.

2. A printer according to claim 1, wherein said cutting means is positioned along the transport path between the inlet and the imaging assembly to sever said trailing edge before transfer of said toned image.

3. A printer according to claim 2, further comprising a slack loop between said inlet and said imaging assembly for accumulating a length of said web ahead of said imaging member.

4. A printer according to claim 3, further comprising a decurler located along said web ahead of the cutting means for removing curl from said web.

5. A printer according to claim 1, further comprising a housing, said housing including a first part hinged to a second part, said first part defining said transport path and said second part containing said imaging assembly, so that by closing the housing the imaging assembly is positioned adjacent the imaging position of the transport path.

6. A printer according to claim 3, wherein the transport assembly further comprises a second web feed, said second web feed being driveable independently from said feed means to accumulate said slack loop between said feed means and said second web feed.

7. A printer according to claim 3, wherein said control means includes storage means for accumulating print data to be applied to the imaging assembly and wherein said control means determines an end-of-print position for actuating said cutting means based on accumulated print data.

8. A printer ascending to claim 1, further comprising separation means distinct from said transferring means for separating said web from the imaging member.

9. A printer for tickets, labels or the like, such printer comprising a transport assembly defining a path having an inlet and an outlet, the inlet receiving a narrow web of print medium, and also including feed means for feeding said web along the path from said inlet having a leading edge an electrographic imaging assembly positioned along said path between the inlet and the outlet, said imaging assembly including an imaging member adjacent an imaging position on said path means for forming a latent charge image on said member means for developing the latent charge image on said member with a toner to produce a toned image, and means for transferring the toned image to said narrow web as the web is fed past said imaging position fixing means for fixing the transferred toned image as a print on the web cutting means for severing a portion including said print from remainder of said web with a single cut, said cut thereby defining a trailing edge of the print and a new leading edge of said remainder of the web, wherein said cutting means is positioned along the transport path between the inlet and the imaging assembly to sever said trailing edge before said print has been produced, and control means for controlling said transport assembly, said imaging assembly and said cutting means so that each print is formed with fixed leading and trailing margins without wastage.

10. A printer according to claim 9, further comprising a slack loop between said inlet and said imaging assembly for accumulating a length of medium between said cutting means and said imaging member, whereby said feed means and said imaging member are operable at different speeds.

11. A printer for tickets, labels or the like, such printer comprising a transport assembly defining a path having an inlet and an outlet, the inlet receiving a narrow web of print medium, and also including feed means for feeding said web along the path from said inlet an electrographic imaging assembly positioned along said path between the inlet and the outlet, said imaging assembly including an imaging member adjacent an imaging position on said path means for forming a latent charge image on said member means for developing the latent charge image on said member with a toner to produce a toned image, and means for transferring the toned image to said narrow web as the web is fed past said imaging position fixing means for fixing the transferred toned image as a print on the web cutting means for severing a portion including said print from remainder of said web with a single cut, said cut thereby defining a trailing edge of the print and a new leading edge of said remainder of the web, and control means for controlling said transport assembly, said imaging assembly and said cutting means, said control means operating said imaging member at a substantially constant speed for forming, developing and transferring said image, and said control means decoupling feeding the web from the inlet, from transport of said web past the imaging position, such that each print is formed with fixed leading and trailing margins without wastage.

12. A printer according to claim 11, wherein said control means decouples by independently driving two sets of feed rollers, and said cutting means is positioned along the transport path to cut the web between said two sets.

13. A printer according to claim 12, wherein the controller operates the two sets of feed rollers to form a loop between said inlet and said imaging assembly for accumulating a length of medium ahead of said imaging means.

14. A printer for tickets, labels or the like, such printer comprising a transport assembly defining a path having an inlet and an outlet, the inlet receiving a narrow web of print medium having a leading edge, and also including a feed mechanism for feeding said web along the path from said inlet an electrographic imaging assembly positioned along said path between the inlet and the outlet, said imaging assembly including an imaging member adjacent an imaging position on said path a latent charge imaging assembly for forming a latent charge image on said member a developing unit for developing the latent charge image on said member with a toner to produce a toned image, and a transfer unit for effecting transfer of the toned image to said narrow web as the web is fed past said imaging position a fixing unit for fixing the transferred toned image as a print on the web a cutter for severing a portion including said print from remainder of said web with a single cut, said cut thereby defining a trailing edge of the print and a new leading edge of said remainder of the web, and a controller for controlling said transport assembly, said imaging assembly and said cutter so that the print is formed after cutting and with fixed leading and trailing margins to reduce wastage.

15. A printer for tickets, labels or the like, such printer comprising a transport assembly defining a path having an inlet and an outlet, the inlet receiving a narrow web of print medium, and also including a feed mechanism for feeding said web having a leading edge along the path from said inlet an electrographic imaging assembly positioned along said path between the inlet and the outlet, said imaging assembly including an imaging member adjacent an imaging position on said path a latent charge imaging assembly for forming a latent charge image on said member a developing unit for developing the latent charge image on said member with a toner to produce a toned image, and a transfer unit for effecting transfer of the toned image to said narrow web as the web is fed past said imaging position a fixing unit for fixing the transferred toned image as a print on the web a cutter for severing a portion including said print from remainder of said web with a single cut, said cut thereby defining a trailing edge of the print and a new leading edge of said remainder of the web, wherein said cutter is positioned along the transport path between the inlet and the imaging assembly to sever said trailing edge before said print has been produced, and a controller for controlling said transport assembly, said imaging assembly and said cutter so that said trailing edge is cut to define a trailing margin at a selected distance following location of a last intended printable line and the web is next fed forward in coordination with position of the image on said imaging mamber, whereby each print is formed with fixed leading and trailing margins without wastage.

16. A printer according to claim 15, wherein said transfer unit includes a charging body for applying a counter-charge to said web for attracting the toned image from said imaging member to the web.

17. A printer according to claim 16, wherein the charging body is selected from among a conductive roller and a corona.

18. A printer according to claim 15, wherein the imaging member is an endless member having a surface of photoconductive material, said material being selected from among selenium, α-silicon and organic photosensitive materials.

19. A printer according to claim 15, wherein the imaging assembly includes a charge-applying member for applying a uniform charge to said imaging member, and wherein the charge applying member includes a charging element selected from among the group consisting of a scorotron, a corotron, a corona, a charging roller and a charging brush.

20. A printer according to claim 15, wherein the controller controls the transport assembly to feed the web in only a single direction.

21. A printer according to claim 20, wherein the transport assembly includes a path segment defining a slack loop of the web, and said cutter severs a trailing portion of said slack loop.

22. A printer according to claim 21, wherein said transport assembly includes a guide for guiding the web in a straight path past the transfer unit.

23. A printer according to claim 22, wherein the transport assembly further defines a turning path away from the transfer unit.

24. A printer according to claim 20, wherein the transport assembly further includes an output drive for moving the print out of the printer.

25. A printer according to claim 24, wherein said fixing unit includes a fusing roll in said output drive.

26. A printer according to claim 20, wherein said developing unit is a dry powder toner developing unit.

27. A printer according to claim 26, wherein the fixing unit is a unit selected from among a radiant energy fixer, a hot pressure fixer and a combination thereof.

28. A printer according to claim 20, wherein said transport assembly includes a plurality of drive rollers and the controller selectively couples said rollers to an imaging member driver to selectively move the web past said cutter, said imaging member and said fixing unit.

29. A printer according to claim 20, wherein said transport assembly includes plural selectively-actuable motors for moving the web past said cutter, said imaging member and said fuser fixing unit.

30. A printer for tickets, labels or the like, such printer comprising a transport assembly defining a path having an inlet and an outlet, the inlet receiving a narrow web of print medium, and also including a feed mechanism for feeding said web along the path from said inlet, wherein said transport assembly and feed mechanism move the web unidirectionally an electrographic imaging assembly positioned along said path between the inlet and the outlet, said imaging assembly including an imaging member adjacent an imaging position on said path a latent imaging assembly for forming a latent charge image on said member a developing unit for developing the latent charge image on said member with a toner to produce a toned image, and a transfer unit for effecting transfer of the toned image to said narrow web as the web is fed past said imaging position a fixing unit for fixing the transferred toned image as a print on the web a cutter for severing a portion including said print from remainder of said web with a single cut, said cut thereby defining a trailing edge of the print and a new leading edge of said remainder of the web, and a controller for controlling said transport assembly, said imaging assembly and said cutter, said controller operating said imaging member at a substantially constant speed for forming, developing and transferring said image, and said controller decoupling feeding the web from the inlet, from transport of said web past the imaging position, such that each print is formed with fixed leading and trailing margins without wastage.

31. An improved method of printing of the type wherein an image is formed by an imaging member and a print medium is presented to the imaging member to transfer the image thereto and produce a print, wherein the method is characterized by the steps of providing said medium as a continuous web of material, driving the web with a first driver along an infeed path past a cutter assembly, at a position following the cutter assembly, separately driving said web along a print path with a second driver to present a portion of the web to the imaging member and receive an image transferred therefrom, and operating the cutter assembly to cut the web in coordination with a defined print line position of the imaging member, the cut being coordinated to produce a trailing edge of said portion between the first and second drivers such that the portion of the web driven by the second driver receives the transferred image with a defined margin without loss of web material.

32. The improved method of claim 31, wherein the first and second drivers are driven to produce a loop therebetween, whereby the drivers may operate at different speeds.

33. The improved method of claim 32, wherein the steps of driving the web with first and second drivers drive said web in a single direction.

34. The improved method of claim 31, further including the step of determining an end-of-print position from accumulated print data, and wherein the step of operating the cutter assembly actuates said assembly in accordance with the end-of-print position so determined.

* * * * *